US007841150B2

(12) United States Patent
Pervan

(10) Patent No.: US 7,841,150 B2
(45) Date of Patent: Nov. 30, 2010

(54) MECHANICAL LOCKING SYSTEM FOR FLOORBOARDS

(75) Inventor: Darko Pervan, Viken (SE)

(73) Assignee: Valinge Innovation AB, Viken (SE)

( * ) Notice: Subject to any disclaimer, the term of this patent is extended or adjusted under 35 U.S.C. 154(b) by 0 days.

(21) Appl. No.: 11/822,688

(22) Filed: Jul. 9, 2007

(65) Prior Publication Data

US 2008/0041008 A1 Feb. 21, 2008

Related U.S. Application Data

(63) Continuation of application No. 10/509,885, filed as application No. PCT/SE03/00514 on Mar. 31, 2003, now Pat. No. 7,757,452.

(30) Foreign Application Priority Data

Apr. 3, 2002 (SE) ..... 0201009
Jan. 31, 2003 (SE) ..... 0300271

(51) Int. Cl.
*E04B 2/00* (2006.01)

(52) U.S. Cl. ..... 52/582.1; 52/380; 52/539; 52/592.2; 428/50

(58) Field of Classification Search ..... 52/588.1, 52/592.1, 582.2, 582.1, 586.1, 586.2, 585.1, 52/591.1, 578, 390, 392, 533, 534, 539, 553, 52/596.1, 589.1, 590.2, 590.3, 591.2, 591.3, 52/591.4, 591.5, 582.4, 745.08, 745.19, 747.1, 52/747.11; 403/372, 375, 376, 381; 404/41, 404/46, 47, 49–58, 68, 70; 428/57, 58, 60, 428/61, 106, 192–194
See application file for complete search history.

(56) References Cited

U.S. PATENT DOCUMENTS 1,723,306 A 8/1929 Sipe
1,743,492 A 1/1930 Sipe
1,787,027 A 12/1930 Wasleff
1,809,393 A 6/1931 Rockwell (Continued)

FOREIGN PATENT DOCUMENTS

DE 1 212 275 B 3/1966

(Continued)

OTHER PUBLICATIONS

Pervan, et al., U.S. Appl. No. 12/518,584, entitled, "Mechanical Locking of Floor Panels,", filed Jun. 10, 2009.

(Continued)

*Primary Examiner*—Richard E Chilcot, Jr.
*Assistant Examiner*—William V Gilbert
(74) *Attorney, Agent, or Firm*—Buchanan Ingersoll & Rooney PC

(57) ABSTRACT

Floorboards (1, 1') are shown, which are provided with a mechanical locking system consisting of a separately machined locking strip (6) which is mechanically joined with the floorboard (1), the locking strip (6) being designed for mechanical fixing to the floorboard (1) by means of a joint, which is operable by snapping-in and/or inward angling, and the locking strip (6) being designed to connect the floorboard (1) with the essentially identical floorboard (1') by at least inward angling.

Moreover, a locking strip, a strip blank, a set of parts for making a floorboard and methods for manufacturing a floorboard and a locking strip, respectively, are shown.

27 Claims, 22 Drawing Sheets

U.S. PATENT DOCUMENTS

| | | | |
|---|---|---|---|
| 1,898,364 | A | 2/1933 | Gynn |
| 1,902,716 | A | 3/1933 | Newton |
| 1,925,070 | A | 8/1933 | Livezey |
| 1,995,264 | A | 3/1935 | Mason |
| 2,015,813 | A | 10/1935 | Nielsen |
| 2,026,511 | A | 12/1935 | Storm |
| 2,088,238 | A | 7/1937 | Greenway |
| 2,089,075 | A | 8/1937 | Siebs |
| 2,204,675 | A | 6/1940 | Grunert |
| 2,303,745 | A | 12/1942 | Karreman |
| 2,430,200 | A | 11/1947 | Wilson |
| 2,596,280 | A | 5/1952 | Nystrom |
| 2,732,706 | A | 1/1956 | Friedman |
| 2,740,167 | A | 4/1956 | Rowley |
| 2,805,852 | A | 9/1957 | Malm |
| 2,865,058 | A | 12/1958 | Andersson et al. |
| 3,023,681 | A | 3/1962 | Worson |
| 3,077,703 | A | 2/1963 | Bergstrom |
| 3,325,585 | A | 6/1967 | Brenneman |
| 3,377,931 | A | 4/1968 | Hilton |
| 3,378,958 | A | 4/1968 | Parks et al. |
| 3,387,422 | A | 6/1968 | Wanzer |
| 3,436,888 | A | 4/1969 | Ottosson |
| 3,512,324 | A | 5/1970 | Reed |
| 3,517,927 | A | 6/1970 | Kennel |
| 3,526,071 | A | 9/1970 | Watanabe |
| 3,535,844 | A | 10/1970 | Glaros |
| 3,538,665 | A | 11/1970 | Gohner |
| 3,554,850 | A | 1/1971 | Kuhle |
| 3,572,224 | A | 3/1971 | Perry |
| 3,579,941 | A | 5/1971 | Tibbals |
| 3,720,027 | A | 3/1973 | Christensen |
| 3,729,368 | A | 4/1973 | Ingham et al. |
| 3,731,445 | A | 5/1973 | Hoffmann et al. |
| 3,742,669 | A | 7/1973 | Mansfeld |
| 3,760,547 | A | 9/1973 | Brenneman |
| 3,842,562 | A | 10/1974 | Daigle |
| 3,849,235 | A | 11/1974 | Gwynne |
| 3,859,000 | A | 1/1975 | Webster |
| 3,919,820 | A | 11/1975 | Green |
| 4,082,129 | A | 4/1978 | Morelock |
| 4,100,710 | A | 7/1978 | Kowallik |
| 4,107,892 | A | 8/1978 | Bellem |
| 4,113,399 | A | 9/1978 | Hansen, Sr. et al. |
| 4,169,688 | A | 10/1979 | Toshio |
| 4,196,554 | A | 4/1980 | Anderson et al. |
| 4,299,070 | A | 11/1981 | Oltmanns |
| 4,304,083 | A | 12/1981 | Anderson |
| 4,426,820 | A | 1/1984 | Terbrack et al. |
| 4,512,131 | A | 4/1985 | Laramore |
| 4,599,841 | A | 7/1986 | Haid |
| 4,819,932 | A | 4/1989 | Trotter, Jr. |
| 5,007,222 | A | 4/1991 | Raymond |
| 5,135,597 | A | 8/1992 | Barker |
| 5,148,850 | A | 9/1992 | Urbanick |
| 5,182,892 | A | 2/1993 | Chase |
| 5,216,861 | A | 6/1993 | Meyerson |
| 5,247,773 | A | 9/1993 | Weir |
| 5,253,464 | A | 10/1993 | Nilsen |
| 5,295,341 | A | 3/1994 | Kajiwara |
| 5,344,700 | A | 9/1994 | McGath et al. |
| 5,349,796 | A | 9/1994 | Meyerson |
| 5,465,546 | A | 11/1995 | Buse |
| 5,548,937 | A | 8/1996 | Shimonohara |
| 5,577,357 | A | 11/1996 | Civelli |
| 5,598,682 | A | 2/1997 | Haughian |
| 5,618,602 | A | 4/1997 | Nelson |
| 5,634,309 | A | 6/1997 | Polen |
| 5,694,730 | A | 12/1997 | Del Rincon et al. |
| 5,695,875 | A | 12/1997 | Larsson et al. |
| 5,755,068 | A | 5/1998 | Ormiston |
| 5,860,267 | A * | 1/1999 | Pervan ..... 52/748.1 |
| 5,899,038 | A | 5/1999 | Stroppiana |
| 5,950,389 | A | 9/1999 | Porter |
| 6,006,486 | A | 12/1999 | Moriau et al. |
| 6,023,907 | A | 2/2000 | Pervan |
| 6,052,960 | A | 4/2000 | Yonemura |
| 6,065,262 | A | 5/2000 | Motta |
| 6,173,548 | B1 | 1/2001 | Hamar et al. |
| 6,182,410 | B1 | 2/2001 | Pervan |
| 6,203,653 | B1 | 3/2001 | Seidner |
| 6,216,409 | B1 | 4/2001 | Roy et al. |
| 6,254,301 | B1 | 7/2001 | Hatch |
| 6,314,701 | B1 | 11/2001 | Meyerson |
| 6,332,733 | B1 | 12/2001 | Hamberger et al. |
| 6,339,908 | B1 | 1/2002 | Chuang |
| 6,358,352 | B1 | 3/2002 | Schmidt |
| 6,363,677 | B1 | 4/2002 | Chen et al. |
| 6,385,936 | B1 | 5/2002 | Schneider |
| 6,418,683 | B1 | 7/2002 | Martensson et al. |
| 6,446,413 | B1 | 9/2002 | Gruber |
| 6,450,235 | B1 | 9/2002 | Lee |
| 6,490,836 | B1 | 12/2002 | Moriau et al. |
| 6,505,452 | B1 | 1/2003 | Hannig et al. |
| 6,536,178 | B1 | 3/2003 | Pålsson et al. |
| 6,553,724 | B1 | 4/2003 | Bigler |
| 6,576,079 | B1 | 6/2003 | Kai |
| 6,591,568 | B1 | 7/2003 | Pålsson |
| 6,601,359 | B2 | 8/2003 | Olofsson |
| 6,647,689 | B2 | 11/2003 | Heitzinger et al. |
| 6,647,690 | B1 | 11/2003 | Martensson |
| 6,711,869 | B2 | 3/2004 | Tychsen |
| 6,729,091 | B1 | 5/2004 | Martensson |
| 6,763,643 | B1 * | 7/2004 | Mårtensson ..... 52/586.1 |
| 6,769,219 | B2 | 8/2004 | Schwitte et al. |
| 6,769,835 | B2 | 8/2004 | Stridsman |
| 6,851,237 | B2 | 2/2005 | Niese et al. |
| 6,854,235 | B2 | 2/2005 | Martensson |
| 6,865,855 | B2 | 3/2005 | Knauseder |
| 6,880,305 | B2 | 4/2005 | Pervan et al. |
| 6,880,307 | B2 | 4/2005 | Schwitte et al. |
| 6,898,913 | B2 | 5/2005 | Pervan |
| 6,918,220 | B2 | 7/2005 | Pervan |
| 6,922,964 | B2 | 8/2005 | Pervan |
| 7,040,068 | B2 | 5/2006 | Moriau et al. |
| 7,051,486 | B2 | 5/2006 | Pervan |
| 7,086,205 | B2 | 8/2006 | Pervan |
| 7,127,860 | B2 | 10/2006 | Pervan et al. |
| 7,188,456 | B2 | 3/2007 | Knauseder |
| 7,251,916 | B2 | 8/2007 | Konzelmann et al. |
| 7,275,350 | B2 | 10/2007 | Pervan |
| 7,328,536 | B2 | 2/2008 | Moriau et al. |
| 7,614,197 | B2 | 11/2009 | Nelson |
| 2002/0007608 | A1 | 1/2002 | Pervan |
| 2002/0007609 | A1 | 1/2002 | Pervan |
| 2002/0031646 | A1 | 3/2002 | Chen et al. |
| 2002/0056245 | A1 | 5/2002 | Thiers |
| 2002/0083673 | A1 | 7/2002 | Kettler et al. |
| 2002/0092263 | A1 | 7/2002 | Schulte |
| 2002/0095894 | A1 | 7/2002 | Pervan |
| 2002/0112429 | A1 | 8/2002 | Niese et al. |
| 2002/0112433 | A1 | 8/2002 | Pervan |
| 2002/0170257 | A1 | 11/2002 | McLain et al. |
| 2002/0178674 | A1 | 12/2002 | Pervan |
| 2002/0178682 | A1 | 12/2002 | Pervan |
| 2003/0009971 | A1 | 1/2003 | Palmberg |
| 2003/0024199 | A1 | 2/2003 | Pervan et al. |
| 2003/0024200 | A1 | 2/2003 | Moriau et al. |
| 2003/0037504 | A1 | 2/2003 | Schwitte et al. |
| 2003/0101674 | A1 | 6/2003 | Pervan et al. |
| 2003/0101681 | A1 | 6/2003 | Tychsen |
| 2003/0180091 | A1 | 9/2003 | Stridsman |
| 2003/0196397 | A1 | 10/2003 | Niese et al. |
| 2003/0196405 | A1 | 10/2003 | Pervan |

| | | | |
|---|---|---|---|
| 2003/0221387 | A1 | 12/2003 | Shah |
| 2004/0031227 | A1 | 2/2004 | Knauseder |
| 2004/0035079 | A1 | 2/2004 | Evjen |
| 2004/0045254 | A1 | 3/2004 | Van Der Heijden et al. |
| 2004/0068954 | A1 | 4/2004 | Martensson |
| 2004/0108625 | A1 | 6/2004 | Moder et al. |
| 2004/0168392 | A1 | 9/2004 | Konzelmann et al. |
| 2004/0177584 | A1 | 9/2004 | Pervan |
| 2004/0211143 | A1 | 10/2004 | Hannig |
| 2004/0261348 | A1 | 12/2004 | Vulin |
| 2005/0055943 | A1 | 3/2005 | Pervan |
| 2005/0138881 | A1 | 6/2005 | Pervan |
| 2005/0160694 | A1 | 7/2005 | Pervan |
| 2005/0166502 | A1 | 8/2005 | Pervan |
| 2005/0208255 | A1 | 9/2005 | Pervan |
| 2005/0210810 | A1 | 9/2005 | Pervan |
| 2005/0252130 | A1 | 11/2005 | Martensson |
| 2005/0268570 | A2 | 12/2005 | Pervan |
| 2006/0070333 | A1 | 4/2006 | Pervan |
| 2006/0075713 | A1 | 4/2006 | Pervan |
| 2006/0101769 | A1 | 5/2006 | Pervan et al. |
| 2006/0236642 | A1 | 10/2006 | Pervan |
| 2006/0260254 | A1 | 11/2006 | Pervan |
| 2006/0283127 | A1 | 12/2006 | Pervan |
| 2007/0011981 | A1 | 1/2007 | Eisermann |
| 2007/0175143 | A1 | 8/2007 | Pervan et al. |
| 2007/0175144 | A1 | 8/2007 | Pervan et al. |
| 2007/0175148 | A1 | 8/2007 | Pervan et al. |
| 2007/0175156 | A1 | 8/2007 | Pervan et al. |
| 2008/0000180 | A1 | 1/2008 | Pervan |
| 2008/0000186 | A1 | 1/2008 | Pervan et al. |
| 2008/0010931 | A1 | 1/2008 | Pervan et al. |
| 2008/0010937 | A1 | 1/2008 | Pervan et al. |
| 2008/0028707 | A1 | 2/2008 | Pervan |
| 2008/0034708 | A1 | 2/2008 | Pervan |
| 2008/0066415 | A1 | 3/2008 | Pervan |
| 2008/0104921 | A1 | 5/2008 | Pervan et al. |
| 2008/0110125 | A1 | 5/2008 | Pervan et al. |
| 2008/0134607 | A1 | 6/2008 | Pervan et al. |
| 2008/0134613 | A1 | 6/2008 | Pervan |
| 2008/0134614 | A1 | 6/2008 | Pervan et al. |
| 2008/0155930 | A1 | 7/2008 | Pervan et al. |
| 2008/0216434 | A1 | 9/2008 | Pervan |
| 2008/0216920 | A1 | 9/2008 | Pervan |
| 2008/0295432 | A1 | 12/2008 | Pervan et al. |
| 2009/0151291 | A1 | 6/2009 | Pervan |
| 2009/0193748 | A1 | 8/2009 | Pervan et al. |

FOREIGN PATENT DOCUMENTS

| | | | |
|---|---|---|---|
| DE | 2 159 042 | | 6/1973 |
| DE | 26 16 077 | A1 | 10/1977 |
| DE | 3 343 601 | A1 | 6/1985 |
| DE | 4 215 273 | A1 | 11/1993 |
| DE | 4 242 530 | A1 | 6/1994 |
| DE | 1 960 1322 | | 5/1997 |
| DE | 199 40 837 | A1 | 11/2000 |
| DE | 199 58 225 | A1 | 6/2001 |
| EP | 0 013 852 | A1 | 8/1980 |
| EP | 0 652 340 | A1 | 5/1995 |
| EP | 0 974 713 | A1 | 1/2000 |
| EP | 1 120 515 | A1 | 8/2001 |
| EP | 1 146 182 | A2 | 10/2001 |
| FR | 1.138.595 | | 6/1957 |
| FR | 1.293.043 | | 5/1962 |
| FR | 2 256 807 | | 8/1975 |
| FR | 2 810 060 | A1 | 12/2001 |
| GB | 812671 | | 4/1959 |
| GB | 1 430 423 | A | 3/1976 |
| GB | 2 051 916 | A | 1/1981 |
| GB | 2 256 023 | A | 11/1992 |
| JP | 1-178659 | A | 7/1989 |
| JP | 3-110258 | A | 5/1991 |
| JP | 3-169967 | A | 7/1991 |
| JP | 61-46553 | A | 5/1994 |
| JP | 7-180333 | A | 7/1995 |
| JP | 7-300979 | A | 11/1995 |
| JP | 7-310426 | A | 11/1995 |
| JP | 10-219975 | A | 8/1998 |
| SE | 372 051 | B | 12/1974 |
| SE | 450 141 | B | 6/1987 |
| SE | 506 254 | C2 | 11/1997 |
| WO | WO 84/02155 | A1 | 6/1984 |
| WO | WO 93/13280 | A1 | 7/1993 |
| WO | WO 94/26999 | A1 | 11/1994 |
| WO | WO 96/27719 | A1 | 9/1996 |
| WO | WO 96/27721 | A1 | 9/1996 |
| WO | WO 97/47834 | A1 | 12/1997 |
| WO | WO 98/38401 | A1 | 9/1998 |
| WO | WO 99/66151 | A1 | 12/1999 |
| WO | WO 99/66152 | A1 | 12/1999 |
| WO | WO 00/20705 | A1 | 4/2000 |
| WO | WO 00/20706 | A1 | 4/2000 |
| WO | WO 00/47841 | A1 | 8/2000 |
| WO | WO 01/02672 | A1 | 1/2001 |
| WO | WO 01/07729 | A1 | 2/2001 |
| WO | WO 01/51732 | A1 | 7/2001 |
| WO | WO 01/66877 | A1 | 9/2001 |
| WO | WO 01/98604 | | 12/2001 |
| WO | WO 02/055809 | A1 | 7/2002 |
| WO | WO 02/055810 | A1 | 7/2002 |
| WO | WO 03/016654 | A1 | 2/2003 |
| WO | WO 03/025307 | A1 | 3/2003 |

OTHER PUBLICATIONS

U.S. Appl. No. 12/518,584, Pervan, et al.

Pervan, Darko, et al., U.S. Appl. No. 12/868,137, entitled "Mechanical Locking System for Floor Panels," filed in the U. S. Patent and Trademark Office on Aug. 25, 2010.

U.S. Appl. No. 12/868,137, Pervan, et al.

* cited by examiner

PRIOR ART

*PRIOR ART*

*PRIOR ART*

*PRIOR ART*

T1
T3
T2
6
T4

T1
T3
T2
T4
15

T1
T3
T2
T4
15
6
6

6

15

15
6

MECHANICAL LOCKING SYSTEM FOR FLOORBOARDS

CROSS-REFERENCE TO RELATED APPLICATIONS

This application is a continuation of application No. 10/509,885, filed Jun. 29, 2005, which is a National Stage of Application No. PCT/SE03/00514, filed Mar. 31, 2003, which claims the benefit of Swedish Application No. 0201009-8, filed on Apr. 3, 2002, and Swedish Application No. 0300271-4, filed on Jan. 31, 2003.

TECHNICAL FIELD

The invention generally relates to the field of mechanical locking systems for floorboards. The invention relates to floorboards provided with such locking systems; elements for such locking systems; and methods for making floorboards with such locking systems. The invention is particularly suited for use in mechanical locking systems of the type described and shown, for example, in WO9426999, WO9966151, WO9966152, SE 0100100-7 and SE 0100101-5 (owned by Välinge Aluminium AB) but is also usable in optional mechanical locking systems which can be used to join floors.

More specifically, the invention relates above all to floors of the type having a core and a decorative surface layer on the upper side of the core.

FIELD OF APPLICATION OF THE INVENTION

The present invention is particularly suitable for use in floating floors, which are formed of floorboards which are joined mechanically with a locking system integrated with the floorboard, i.e. mounted at the factory, are made up of one or more upper layers of veneer, decorative laminate or decorative plastic material, an intermediate core of wood-fibre-based material or plastic material and preferably a lower balancing layer on the rear side of the core, and are manufactured by sawing large floor elements into floor panels. The following description of prior-art technique, problems of known systems and objects and features of the invention will therefore, as a non-restrictive example, be aimed above all at this field of application and in particular laminate flooring formed as rectangular floorboards intended to be mechanically joined on both long sides and short sides. However, it should be emphasised that the invention can be used in any floorboards with any locking systems, where the floorboards can be joined using a mechanical locking system in the horizontal and vertical directions. The invention can thus also be applicable to, for instance, homogeneous wooden floors, parquet floors with a core of wood or wood-fibre-based material and the like which are made as separate floor panels, floors with a printed and preferably also varnished surface and the like. The invention can also be used for joining, for instance, of wall panels.

BACKGROUND OF THE INVENTION

Laminate flooring usually consists of a core of a 6-11 mm fibreboard, a 0.2-0.8 mm thick upper decorative surface layer of laminate and a 0.1-0.6 mm thick lower balancing layer of laminate, plastic, paper or like material. The surface layer provides appearance and durability to the floorboards. The core provides stability, and the balancing layer keeps the board plane when the relative humidity (RH) varies during the year. The floorboards are laid floating, i.e. without gluing, on an existing subfloor. Traditional hard floorboards in floating flooring of this type are usually joined by means of glued tongue-and-groove joints (i.e. joints involving a tongue on one floorboard and a tongue groove on an adjoining floorboard) on long side and short side. When laying the floor, the boards are brought together horizontally, whereby a projecting tongue along the joint edge of one board is introduced into a tongue groove along the joint edge of an adjoining board. The same method is used on the long side as well as on the short side.

In addition to such traditional floors, which are joined by means of glued tongue-and-groove joints, floorboards have recently been developed which do not require the use of glue and instead are joined mechanically by means of so-called mechanical locking systems. These systems comprise locking means which lock the boards horizontally and vertically. The mechanical locking systems are usually formed by machining of the core of the board. Alternatively, parts of the locking system can be formed of a separate material, for instance aluminium, which is integrated with the floorboard, i.e. joined with the floorboard even in connection with the manufacture thereof.

The main advantages of floating floors with mechanical locking systems are that they can easily and quickly be laid by various combinations of inward angling, snapping-in and insertion. They can also easily be taken up again and used once more at a different location. A further advantage of the mechanical locking systems is that the edge portions of the floorboards can be made of materials which need not have good gluing properties. The most common core material is a fibreboard with high density and good stability usually called HDF—High Density Fibreboard. Sometimes also MDF—Medium Density Fibreboard—is used as core.

Laminate flooring and also many other floorings with a surface layer of plastic, wood, veneer, cork and the like are made by the surface layer and the balancing layer being applied to a core material. This application may take place by gluing a previously manufactured decorative layer, for instance when the fibreboard is provided with a decorative high pressure laminate which is made in a separate operation where a plurality of impregnated sheets of paper are compressed under high pressure and at a high temperature. The currently most common method when making laminate flooring, however, is direct laminating which is based on a more modern principle where both manufacture of the decorative laminate layer and the fastening to the fibreboard take place in one and the same manufacturing step. Impregnated sheets of paper are applied directly to the board and pressed together under pressure and heat without any gluing.

In addition to these two methods, a number of other methods are used to provide the core with a surface layer. A decorative pattern can be printed on the surface of the core, which is then, for example, coated with a wear layer. The core can also be provided with a surface layer of wood, veneer, decorative paper or plastic sheeting, and these materials can then be coated with a wear layer. The core can also be provided with a soft wear layer, for instance needle felt. Such a floor has good acoustic properties.

As a rule, the above methods result in a floor element in the form of a large board which is then sawn into, for instance, some ten floor panels, which are then machined to floorboards. The above methods can in some cases result in completed floor panels and sawing is then not necessary before the machining to completed floorboards is carried out. Manufacture of individual floor panels usually takes place when the panels have a surface layer of wood or veneer.

In all cases, the above floor panels are individually machined along their edges to floorboards. The machining of the edges is carried out in advanced milling machines where the floor panel is exactly positioned between one or more chains and bands mounted, so that the floor panel can be moved at high speed and with great accuracy past a number of milling motors, which are provided with diamond cutting tools or metal cutting tools, which machine the edge of the floor panel. By using several milling motors operating at different angles, advanced joint geometries can be formed at speeds exceeding 100 m/min and with an accuracy of ±0.02 mm.

Definition of Some Terms

In the following text, the visible surface of the installed floorboard is called "front side", while the opposite side of the floorboard, facing the subfloor, is called "rear side". The sheet-shaped starting material that is used is called "core". When the core is coated with a surface layer closest to the front side and preferably also a balancing layer closest to the rear side, it forms a semimanufacture which is called "floor panel" or "floor element" in the case where the semimanufacture, in a subsequent operation, is divided into a plurality of floor panels mentioned above. When the floor panels are machined along their edges so as to obtain their final shape with the locking system, they are called "floorboards". By "surface layer" are meant all layers applied to the core closest to the front side and covering preferably the entire front side of the floorboard. By "decorative surface layer" is meant a layer which is mainly intended to give the floor its decorative appearance. "Wear layer" relates to a layer which is mainly adapted to improve the durability of the front side. In laminate flooring, this layer usually consists of a transparent sheet of paper with an admixture of aluminium oxide which is impregnated with melamine resin. By "reinforcing layer" is meant a layer which is mainly intended to improve the capability of the surface layer of resisting impact and pressure and, in some cases, compensating for the irregularities of the core so that these will not be visible at the surface. In high pressure laminates, this reinforcing layer usually consists of brown kraft paper which is impregnated with phenol resin. By "horizontal plane" is meant a plane which extends parallel to the outer part of the surface layer. Immediately juxtaposed upper parts of two neighbouring joint edges of two joined floorboards together define a "vertical plane" perpendicular to the horizontal plane.

The outer parts of the floorboard at the edge of the floorboard between the front side and the rear side are called "joint edge". As a rule, the joint edge has several "joint surfaces" which can be vertical, horizontal, angled, rounded, bevelled etc. These joint surfaces exist on different materials, for instance laminate, fibreboard, wood, plastic, metal (especially aluminium) or sealing material. By "joint edge portion" are meant the joint edge of the floorboard and part of the floorboard portions closest to the joint edge.

By "joint" or "locking system" are meant coacting connecting means which connect the floorboards vertically and/or horizontally. By "mechanical locking system" is meant that joining can take place without glue. Mechanical locking systems can in many cases also be joined by gluing.

By "wood-based materials" are meant materials which essentially consist of combinations of wood and/or wood fibres. Examples of such materials are homogeneous wood, wood slats, particle board, plywood, HDF, MDF, compact laminate and like materials. Wood-based materials containing wood fibres can be bound by a binder of the type thermosetting plastic or the like, for instance melamine, phenol or urea. These materials are characterised by good formability by cutting and by exhibiting relatively little thermal expansion. Wood-based material does not include materials containing wood or wood fibres in small amounts only. Nor are wood fibre-reinforced thermoplastics regarded as "wood-based".

By "strip blank" are meant two or more locking strips which are made by forming a common starting material but which are still in one piece. Examples of such strip blanks will be described in more detail below.

By "fixing" is meant in connection with the locking strip according to the invention that the locking strip should at least be sufficiently attached to the floorboard so as not to incidentally fall off during handling of the floorboard at the factory, during transport and/or in installation. The term "fix" thus does not exclude that the locking strip can be detachable. Nor does the term "fix" exclude that the locking strip, after, for instance at the factory or before installation, being arranged in the joint edge of the floorboard, may be somewhat displaced from its intended position, relative to the floorboard, for instance owing to the fact that the joining of floorboard and locking strip has not been completely performed. Moreover, the term "fix" does not exclude that the locking strip, also when fixed to the floorboard, can be displaceable parallel to the joint edge of the floorboard. By "mechanically fixed" is meant that the fixing is essentially due to shape.

By "snapping" is meant connection which during a first stage occurs by a connecting part being bent or compressed, and during a second stage wholly or partly springing back or expanding.

By "angling" is meant connection that occurs by a turning motion, during which an angular change occurs between two parts that are being connected, or disconnected. When angling relates to connection of two floorboards, the angular motion can take place with the upper parts of joint edges at least partly being in contact with each other, during at least part of the motion.

The above techniques can be used to manufacture laminate floorings which are highly natural copies of wooden flooring, stones, tiles and the like and which are very easy to install using mechanical locking systems. Length and width of the floorboards are as a rule 1.2*0.2 m. Recently also laminate floorings in other formats are being marketed. The techniques used to manufacture such floorboards with mechanical locking systems, however, are still relatively expensive since the machining of the joint portions for the purpose of forming the mechanical locking system causes considerable amounts of wasted material, in particular when the width of the floorboards is reduced so that the length of the joint portions per square meter of floor surface increases. It should be possible to manufacture new formats and to increase the market for these types of flooring significantly if the mechanical locking systems could be made in a simpler and less expensive manner and with improved function.

Prior-Art Technique and Problems Thereof

With a view to facilitating the understanding and the description of the present invention as well as the knowledge of the problems behind the invention, both the basic construction and the function of floorboards according to WO 9426999 as well as the manufacturing principles for manufacturing laminate flooring and mechanical locking systems in general will now be described with reference to FIGS. 1-8 in the accompanying drawings. In applicable parts, the subsequent description of prior-art technique also applies to the embodiments of the present invention that will be described below.

FIGS. 3*a* and 3*b* show a floorboard 1 according to WO 9426999 from above and from below respectively. The board 1 is rectangular and has an upper side 2, a lower side 3, two opposite long sides with joint edge portions 4*a* and 4*b*, respectively, and two opposite short sides with joint edge portions 5*a* and 5*b*, respectively.

Both the joint edge portions 4*a*, 4*b* of the long sides and the joint edge portions 5*a*, 5*b* of the short sides can be joined mechanically without glue in a direction D2 in FIG. 1*c*, so as to meet in a vertical plane VP (marked in FIG. 2*c*) and in such manner that, when installed, they have their upper sides in a common horizontal plane HP (marked in FIG. 2*c*).

In the shown embodiment which is an example of floorboards according to WO 9426999 (FIGS. 1-3 in the accompanying drawings), the board 1 has a factory-mounted flat strip 6, which extends along the entire long side 4*a* and which is made of a bendable, resilient aluminium sheet. The strip 6 extends outwards past the vertical plane VP at the joint edge portion 4*a*. The strip 6 can be mechanically attached according to the shown embodiment or by gluing or in some other way. As stated in said publications, it is possible to use as material of a strip, which is attached to the floorboard at the factory, also other strip materials, such as sheet of some other metal, aluminium or plastic sections. As is also stated in WO 9426999, the strip 6 can instead be formed integrally with the board 1, for instance by suitable machining of the core of the board 1.

The present invention is mainly usable for improving floorboards where the strip 6 or at least part thereof is formed in one piece with the core, and the invention solves special problems that exist in such floorboards and the manufacture thereof. The core of the floorboard need not be, but is preferably, made of a uniform material. The strip 6 is always integrated with the board 1, i.e. it should be formed on the board or be factory mounted.

A similar, although shorter strip 6' is arranged along one short side 5*a* of the board 1. The part of the strip 6 projecting past the vertical plane VP is formed with a locking element 8 which extends along the entire strip 6. The locking element 8 has in the lower part an operative locking surface 10 facing the vertical plane VP and having a height of e.g. 0.5 mm. During laying, this locking surface 10 coacts with a locking groove 14 which is formed in the underside 3 of the joint edge portion 4*b* on the opposite long side of an adjoining board 1'. The strip 6' along one short side is provided with a corresponding locking element 8', and the joint edge portion 5*b* of the opposite short side has a corresponding locking groove 14'. The edge of the locking grooves 14, 14' facing away from the vertical plane VP forms an operative locking surface 10' for coaction with the operative locking surface 10 of the locking element.

For mechanical joining of long sides as well as short sides also in the vertical direction (direction D1 in FIG. 1*c*), the board 1 is also along one long side (joint edge portion 4*a*) and one short side (joint edge portion 5*a*) formed with a laterally open recess or groove 16. This is defined upwards by an upper lip at the joint edge portion 4*a*, 5*a* and downwards by the respective strips 6, 6'. At the opposite edge portions 4*b* and 5*b* there is an upper milled-out portion 18 which defines a locking tongue 20 coacting with the recess or groove 16 (see FIG. 2*a*).

FIGS. 1*a*-1*c* show how two long sides 4*a*, 4*b* of two such boards 1, 1' on a base U can be joined by downward angling by turning about a centre C close the intersection between the horizontal plane HP and the vertical plane VP while the boards are held essentially in contact with each other.

FIGS. 2*a*-2*c* show how the short sides 5*a*, 5*b* of the boards 1, 1' can be joined by snap action. The long sides 4*a*, 4*b* can be joined by means of both methods, while the joining of the short sides 5*a*, 5*b*—after laying the first row of floorboards—is normally carried out merely by snap action, after joining of the long sides 4*a*, 4*b*.

When a new board 1' and a previously installed board 1 are to be joined along their long side edge portions 4*a*, 4*b* according to FIGS. 1*a*-1*c*, the long side edge portion 4*b* of the new board 1' is pressed against the long side edge portion 4*a* of the previously installed board 1 according to FIG. 1*a*, so that the locking tongue 20 is inserted into the recess or groove 16. The board 1' is then angled down towards the subfloor U according to FIG. 1*b*. The locking tongue 20 enters completely the recess or groove 16 while at the same time the locking element 8 of the strip 6 snaps into the locking groove 14. During this downward angling, the upper part 9 of the locking element 8 can be operative and perform guiding of the new board 1' towards the previously installed board 1.

In the joined position according to FIG. 1*c*, the boards 1, 1' are certainly locked in the D1 direction as well as the D2 direction along their long side edge portions 4*a*, 4*b*, but the boards 1, 1' can be displaced relative to each other in the longitudinal direction of the joint along the long sides (i.e. direction D3).

FIGS. 2*a*-2*c* show how the short side edge portions 5*a* and 5*b* of the boards 1, 1' can be mechanically joined in the D1 direction as well as the D2 direction by the new board 1' being displaced essentially horizontally towards the previously installed board 1. In particular this can be done after the long side of the new board 1' by inward angling according to FIGS. 1*a*-*c* has been joined with a previously installed board 1 in a neighbouring row. In the first step in FIG. 2*a*, bevelled surfaces adjacent to the recess 16 and the locking tongue 20, respectively, coact so that the strip 6' is forced downwards as a direct consequence of the joining of the short side edge portions 5*a*, 5*b*. During the final joining, the strip 6' snaps upwards when the locking element 8' enters the locking groove 14', so that the operative locking surfaces 10, 10' of the locking element 8' and the locking groove 14', respectively, come into engagement with each other.

By repeating the operations illustrated in FIGS. 1*a*-1*c* and 2*a*-*c*, the entire installation can be made without gluing and along all joint edges. Thus, prior-art floorboards of the above-mentioned type can be joined mechanically by, as a rule, first being angled down on the long side and by the short sides, once the long side is locked, snapping together by horizontal displacement of the new board 1' along the long side of the previously installed board 1 (direction D3). The boards 1, 1' can, without the joint being damaged, be taken up again in reverse order of installation and then be laid once more. Parts of these laying principles are applicable also in connection with the present invention.

The locking system enables displacement along the joint edge in the locked position after an optional side has been joined. Therefore laying can take place in many different ways which are all variants of the three basic methods Angling of long side and snapping-in of short side.

Snapping-in of long side—snapping-in of short side.

Angling of short side, displacement of the new board along the short side edge of the previous board and finally downward angling of two boards. These laying methods can also be combined with insertion along the joint edge. Snapping-in occurs mainly by horizontal displacement of the boards towards each other. The locking system may, however, be formed so that snapping-in may occur by a motion which is vertical to or at an angle to the surface of the floorboard.

The most common and safest laying method is that the long side is first angled downwards and locked against another floorboard. Subsequently, a displacement in the locked position takes place towards the short side of a third floorboard so that the snapping-in of the short side can take place. Laying can also be made by one side, long side or short side, being snapped together with another board. Then a displacement in the locked position takes place until the other side snaps together with a third board. These two methods require snapping-in of at least one side. However, laying can also take place without snap action. The third alternative is that the short side of a first board is angled inwards first towards the short side of a second board, which is already joined on its long side with a third board. After this joining-together, usually the first and the second board are slightly angled upwards. The first board is displaced in the upwardly angled position along its short side until the upper joint edges of the first and the third board are in contact with each other, after which the two boards are jointly angled downwards.

The above-described floorboard and its locking system have become very successful on the market. A number of variants of this locking system are available on the market, above all in connection with laminate floors but also thin wooden floors with a surface of veneer and parquet floors.

Taking-up can be carried out in various ways. All methods require, however, that the long sides can be angled upwards. Then the short sides can be angled upwards or be pulled out along the joint edge. One exception involves small floorboards with a size corresponding to a parquet block which is laid, for instance, in herringbone pattern. These small floorboards can be detached by being pulled out along the long side so that the short sides snap out. The possibility of angling mainly long sides is very important for a well-functioning locking system. Taking-up is usually carried out starting in the first or last row of the installed floor.

FIGS. 5*a*-5*e* show manufacture of a laminate floor. FIG. 5*a* shows manufacture of high pressure laminate. A wear layer 34 of a transparent material with great wearing strength is impregnated with melamine with aluminium oxide added. A decorative layer 35 of paper impregnated with melamine is placed under this layer 34. One or more reinforcing layers 36*a*, 36*b* of core paper impregnated with phenol are placed under the decorative layer 35 and the entire packet is placed in a press where it cures under pressure and heat to an about 0.5-0.8 mm thick surface layer 31 of high pressure laminate. FIG. 5*c* shows how this surface layer 31 can then be glued together with a balancing layer 32 to a core 30 to constitute a floor element 3.

FIGS. 5*d* and 5*e* illustrate direct lamination. A wear layer 34 in the form of an overlay and a decorative layer 35 of decoration paper is placed directly on a core 30, after which all three parts and, as a rule, also a rear balancing layer 32 are placed in a press where they cure under heat and pressure to a floor element 3 with a decorative surface layer 31 having a thickness of about 0.2 mm.

After lamination, the floor element is sawn into floor panels. When the mechanical locking system is made in one piece with the core of the floorboard, the joint edges are formed in the subsequent machining to mechanical locking systems of different kinds which all lock the floorboards in the horizontal D2 and vertical D1 directions.

FIGS. 4*a*-*d* show in four steps manufacture of a floorboard. FIG. 4*a* shows the three basic components surface layer 31, core 30 and balancing layer 32. FIG. 4*b* shows a floor element 3 where the surface layer and the balancing layer have been applied to the core. FIG. 4*c* shows how floor panels 2 are made by dividing the floor element. FIG. 4*d* shows how the floor panel 2 after machining of its edges obtains its final shape and becomes a complete floorboard 1 with a locking system 7, 7', which in this case is mechanical, on the long sides 4*a*, 4*b*.

FIGS. 6*a*-8*b* show some common variants of mechanical locking systems which are formed by machining the core of the floorboard. FIGS. 6*a, b* illustrate a system which can be angled and snapped with excellent function. FIGS. 7*a, b* show a snap joint which cannot be opened by upward angling. FIGS. 8*a, b* show a joint which can be angled and snapped but which has less strength and a poorer function than the locking system according to FIG. 6. As is evident from these Figures, the mechanical locking systems have parts which project past the upper joint edges and this causes expensive waste (w), owing to the removing of material performed by the sawblade SB when dividing the floor element and when surface material is removed and the core is machined in connection with the forming of the parts of the locking system.

These systems and the manufacturing methods suffer from a number of drawbacks which are above all related to cost and function.

The aluminium oxide and also the reinforcing layers which give the laminate floor its high wearing strength and impact resistance cause great wear on the tools the teeth of which consist of diamond. Frequent and expensive regrinding must be made particularly of the tool parts that remove the surface layer.

Machining of the joint edges causes expensive waste when core material and surface material are removed to form the parts of the locking system.

To be able to form a mechanical locking system with projecting parts, the width of the floorboard must usually be increased and the decoration paper must also in many cases be adjusted as to width. This may result in production problems and considerable investments especially when manufacturing parquet flooring.

A mechanical locking system has a more complicated geometry than a traditional locking system which is joined by gluing. The number of milling motors must usually be increased, which requires that new and more advanced milling machines be provided.

To satisfy the requirements as to strength, flexibility in connection with snapping-in and low friction in connection with displacement in the locked position, the core must be of high quality. Such quality requirements, which are necessary for the locking system, are not always necessary for the other properties of the floor, such as stability and impact strength. Owing to the locking system, the core of the entire floorboard must thus be of unnecessarily high quality, which increases the manufacturing cost.

To counteract these problems, different methods have been used. The most important method is to limit the extent of the projecting parts past the upper joint edge. This usually causes poorer strength and difficulties in laying or detaching the floorboards.

Another method is to manufacture parts of the locking system of another material, such as aluminium sheet or aluminium sections. These methods may result in great strength and good function but are as a rule significantly more expensive. In some cases, they may result in a somewhat lower cost than a machined embodiment, but this implies that floorboards are expensive to manufacture and that the waste is very costly, as may be the case when the floorboards are made of, for example, high quality high pressure laminate. In less expensive floorboards of low pressure laminate, the cost of these locking systems of metal is higher than in the case where the locking system is machined from the core of the board. The investment in special equipment, which is necessary to form and attach the aluminium strip to the joint edge of the floorboard, may be considerable.

It is also known that separate materials can be glued as an edge portion and formed by machining in connection with further machining of the joint edges. Gluing is difficult and machining cannot be simplified.

Floorboards can also be joined by means of separate loose clamps of metal which in connection with laying are joined with the floorboard. This results in laborious laying and the manufacturing costs is high. Clamps are usually placed under the floorboard and fixed to the rear side of the floorboard. They are not convenient for use in thin flooring. Examples of such clamps are described in DE 42 15 273 and U.S. Pat. No. 4,819,932. Fixing devices of metal are disclosed in U.S. Pat. No. 4,169,688, U.S. Pat. No. 5,295,341, DE 33 43 601 and JP 614,553. EP 1 146 182 discloses sections of thermoplastic which can be snapped into the joint portion and which lock the floorboards with a snap function. All these alternatives have a poor function and are more expensive in manufacture and use than prior-art machined locking systems. WO 96/27721 discloses separate joint parts which are fixed to the floorboard by gluing. This is an expensive and complicated method.

WO 00/20705 discloses joining of floorboards by means of a non-integrated section of extruded thermoplastic. The section has a symmetrical cross-section and all shown sections allow only joining of floorboards by means of different snap joints. Such loose sections make laying of the floorboards more complicated and time-consuming.

BRIEF DESCRIPTION OF THE INVENTION AND OBJECTS THEREOF

An object of the present invention is to eliminate or significantly reduce one or more of the problems occurring in connection with manufacture of floorboards with mechanical locking systems. This is applicable in particular to such floorboards with mechanical locking systems as are made in one piece with the core of the floorboard. A further object of the invention is to provide a rational and cost-efficient manufacturing method for manufacturing elements which are later to constitute parts of the mechanical locking system of the floorboards. A third object is to provide a rational method for joining of these elements with the joint portion of the floorboard to form an integrated mechanical locking system which locks vertically and horizontally. A fourth object is to provide a locking system which allows laying and taking-up of floorboards which are positioned between the first laid and the last laid rows in an already joined floor.

A fifth object is to provide a joint system and floorboards which can be laid by a vertical motion parallel to the vertical plane.

The invention is based on a first knowledge that parts of the mechanical locking system should be made of a separate locking strip which may have other properties than the floorboard core, which does not contain expensive surface layers that are difficult to machine and which can be made of a board material thinner than the core of the floorboard. This makes it possible to reduce the amount of wasted material and the locking system can be given better properties specially adjusted to function and strength requirements on long side and short side.

The invention is based on a second knowledge that the separate locking strip should preferably be made of a sheet-shaped material which by mechanical machining can be given its final shape in a cost-efficient manner and with great accuracy.

The locking strip should, but does not have to, already be integrated with the floorboard in connection with manufacture. This facilitates laying. The invention is based on a third knowledge that it should be possible to integrate the locking strip with the joint edge portion of the floorboard in a rational manner with great accuracy and strength, preferably by mechanical joining where a preferred alternative may involve snapping-in into the core of the floorboard essentially parallel to the horizontal plane of the floorboard. Snapping-in, which can also be combined with an angular motion, should preferably be effected by a change in shape of a tongue groove in the joint edge portion of the floorboard. The mechanical joining between the floorboard and the separate locking strip should preferably enable a relative movement between the floorboard and the separate locking strip along the joint edge. In this way, it may be possible to eliminate tensions, in the cases where the floorboard and the locking strip move differently owing to the moisture and heat movements of different materials. The mechanical joining gives great degrees of freedom when selecting materials since the gluing problems do not exist.

The locking strip can, of course, also be supplied as a separate unit and can then be joined with the floorboard in connection with laying. Joining in connection with laying can be facilitated if the strips are supplied as a strip blank consisting of several locking strips or in special cassettes. The strips can then be joined by means of special tools where the floorboard, for instance, is pressed against the tool so that joining by inward angling and/or snapping-in of the locking strip can take place. Such loose locking strips are advantageous, especially in the case where they are manufactured by machining a wood-based board material, for instance HDF. Such locking strips will be dimensionally stable and can be manufactured at a cost which is considerably less than that of extruded metal or plastic sections. Their strength is very high and they can easily be sawn in connection with laying of the floor. In connection with these operations, the locking strips of a strip blank can also be separated from each other.

The invention is based on a fourth knowledge that machining of the edges of the floorboards can be made in a simpler and quicker manner with fewer and simpler tools which are both less expensive to buy and less expensive to grind, and that more advanced joint geometries can be provided if the manufacture of the locking system is made by machining a separate locking strip which can be formed of a sheet-shaped material with good machining properties. This separate locking strip can, after machining, be integrated with the floorboard in a rational manner.

The invention is based on a fifth knowledge that the flexibility of the locking strip in connection with snapping-in of the floorboards against each other can be improved by the locking strip being made of a material which has better flexibility than the core of the floorboard and by the separate locking strip being able to move in the snap joint.

Finally, the invention is based on the knowledge that several locking strips should be made in the same milling operation and that they should be made in such manner that they can be joined with each other to form a strip blank. In this way, the locking strips can be made, handled, separated and integrated with the floorboard in a rational and cost-efficient manner and with great accuracy.

The above objects of the invention are achieved wholly or partly by a floorboard, a locking strip, a strip blank, a set of parts and methods according to the independent claims. Embodiments of the invention are evident from the dependent claims and from the description and drawings. According to a first aspect of the invention, a floorboard is provided, comprising connecting means, integrated with the floorboard, for connecting the floorboard with an essentially identical floorboard, so that upper joint edges of said floorboard and said essentially identical floorboard in the connected state define a vertical plane. The connecting means are designed to connect said floorboard with said essentially identical floorboard in at least a horizontal direction, perpendicular to said vertical plane. The connecting means comprises a locking strip projecting from said vertical plane and carrying a locking element, which is designed to cooperate, in said connected state, with a downwards open locking groove of said essentially identical floorboard. The locking strip consists of a separate part which is arranged on the floorboard. The locking strip is mechanically fixed to the floorboard in said horizontal and vertical directions. The floorboard is distinguished by the locking strip being mechanically fixed to the floorboard by means of a joint which is operable by snapping-in and/or inward angling, and the locking strip being designed for connection of the floorboard with the essentially identical floorboard by at least inward angling.

The floorboard according to the invention allows, owing to the locking strip being a separate part, minimising of the wasted material that relates to removal of such material as constitutes the core of the floorboard. Moreover, quick mounting of the locking strip on the floorboard is enabled while at the same time a floorboard is obtained, which can be laid by inward angling. This is particularly advantageous in connecting the long side of the floorboard with the long side or short side of an essentially identical floorboard.

The invention is especially suited for use in floorboards whose locking system comprises a separate locking strip which is machined from a sheet-shaped material, preferably containing wood fibres, for instance particle board, MDF, HDF, compact laminate, plywood and the like. Such board materials can be machined rationally and with great accuracy and dimensional stability. HDF with high density, for instance about 900 kg/m$^3$ or higher, and compact laminate consisting of wood fibres and thermosetting plastics, such as melamine, urea or phenol, are very suitable as semimanufactures for manufacturing strip blanks. The above-mentioned board materials can also by, for instance, impregnation with suitable chemicals in connection with the manufacture of the board material or alternatively before or after machining, when they have been formed to strip blanks or locking strips. They can be given improved properties, for instance regarding strength, flexibility, moisture resistance, friction and the like. The locking strips can also be coloured for decoration. Different colours can be used for different types of floors. The board material may also consist of different plastic materials which by machining are formed to locking strips. Special board materials can be made by gluing or lamination of, for instance, different layers of wood fibreboards and plastic material. Such composite materials can be adjusted so as to give, in connection with the machining of the locking strips, improved properties in, for instance, joint surfaces which are subjected to great loads or which should have good flexibility or low friction. It is also possible to form locking strips as sections by extrusion of thermoplastic, composite sections or metal, for instance aluminium.

The locking strips may consist of the same material as the core of the floorboard, or of the same type of material as the core, but of a different quality, or of a material quite different from that of the core.

The locking strips can also be formed so that part thereof is visible from the surface and constitutes a decorative portion.

The locking strips can also have sealing means preventing penetration of moisture into the core of the floorboard or through the locking system. They can also be provided with compressible flexible layers of e.g. rubber material.

The locking strips can be positioned on long side and short side or only on one side. The other side may consist of some other traditional or mechanical locking system. The locking systems can be mirror-inverted and they can allow locking of long side against short side.

The locking strips on long side and short side can be made of the same material and have the same geometry, but they may also consist of different materials and/or have different geometries. They can be particularly adjusted to different requirements as to function, strength and cost that are placed on the locking systems on the different sides. The long side contains, for example, more joint material than the short side and is usually laid by laying. At the short side the strength requirements are greater and joining often takes place by snapping-in which requires flexible and strong joint materials.

As mentioned above, inward angling of mainly long sides is advantageous. A joint system that allows inward angling and upward angling usually requires a wide locking strip that causes much waste. Thus the invention is particularly suited for joint systems which can be angled about upper joint edges. The invention is also especially suited for e.g. short sides, for which the strength requirements are high and which have locking systems intended to be joined by at least snapping-in. Strong and flexible materials may be used. Various combinations of materials may be used on long sides and short sides. For instance, the short sides may have a strip of HDF with high density, of compact laminate or plywood while the long sides may have a strip of HDF with lower density. Long and short sides may thus have different locking systems, locking strips of different materials and joint systems which on one side can be made in one piece with the core and which on the other side may consist of a separate material according to the invention.

The shape of the floorboard can be rectangular or square. The invention is particularly suited for narrow floorboards or floorboards having the shape of e.g. parquet blocks. Floors with such floorboards contain many joints and separate joint parts then yield great savings. The invention is also particularly suited for thick laminate flooring, for instance 10-12 mm, where the cost of waste is high and about 15 mm parquet flooring with a core of wooden slats, where it is difficult to form a locking system by machining wood material along and transversely of the direction of the fibres. A separate locking strip can give considerable advantages as to cost and a better function.

It is also not necessary for the locking strip to be located along the entire joint edge. The long side or the short side can, for instance, have joint portions that do not contain separate joint parts. In this manner, additional cost savings can be achieved, especially in the cases where the separate locking strip is of high quality, for instance compact laminate.

The separate locking strip may constitute part of the horizontal and vertical joint, but it may also constitute merely part of the horizontal or the vertical joint.

The various aspects of the invention below can be used separately or in an optional combination. Thus, a number of combinations of different locking systems, materials, manufacturing methods and formats can be provided. It should be particularly pointed out that the mechanical joining between the floorboard and the locking separate strip may also consist of a glue joint which improves joining. The mechanical joining can then, for instance, be used to position the joint part and/or to hold it in the correct position until the glue cures.

Thus, according to one embodiment, a floorboard with the above joint system is provided, characterised by the combination that the locking strip is made of HDF, snapping-in can take place relative to a groove/strip groove in the joint edge portion of the floorboard, this groove/strip groove being dimensionally changed in connection with snapping-in, and the floorboard has at least two opposite sides which can be joined or detached by an angular motion about the joint edge.

According to further aspects of the invention, a locking strip, a strip blank and a set of parts are provided, which are intended to form a floorboard according to the first aspect. The invention also comprises methods for manufacturing floorboards and locking strips according to the other aspects of the invention.

Thus, in one embodiment a strip blank is provided, which is intended as semimanufacture for making floorboards with a mechanical locking system which locks the floorboards vertically and horizontally. The strip blank consists of a sheet-shaped blank intended for machining, characterized in that the strip blank consists of at least two locking strips which constitute the horizontal joint in the locking system.

Moreover there is provided a method of providing rectangular floorboards, which have machined joint portions, with a mechanical locking system which locks the floorboards horizontally and vertically on at least two opposite sides, said locking system consisting of at least one separate locking strip, characterised in that the locking strip is made by machining of a sheet-shaped material, the locking strip is joined with the joint portion mechanically in the horizontal direction and in the vertical direction perpendicular to the principal plane, and the mechanical joining takes place by snapping-in relative to the joint edge.

Moreover a floorboard with a vertical joint in the form of a tongue and a groove is provided, the tongue being made of a separate material and being flexible so that at least one of the sides of the floorboard can be joined by a vertical motion parallel to the vertical plane.

Furthermore, floorboards are provided, which can be taken up and laid once again in an installed floor, which floorboards are joined with other floorboards in the portions of the floor which are located between the outer portions of the floor.

The invention will now be described in more detail with reference to the accompanying drawings, which by way of example illustrate embodiments of the invention.

BRIEF DESCRIPTION OF THE DRAWINGS

FIGS. 15*a-d* show a production-adjusted embodiment of the invention and joining of floorboards by inward angling and snapping-in.

DESCRIPTION OF EMBODIMENTS OF THE INVENTION

A first preferred embodiment of a floorboard 1, 1' provided with a mechanical locking system according to the invention will now be described with reference to FIGS. 9*a-d*. To facilitate understanding, the locking system is shown schematically. It should be emphasised that an improved function can be achieved using other preferred embodiments that will be described below.

Figure 1A:
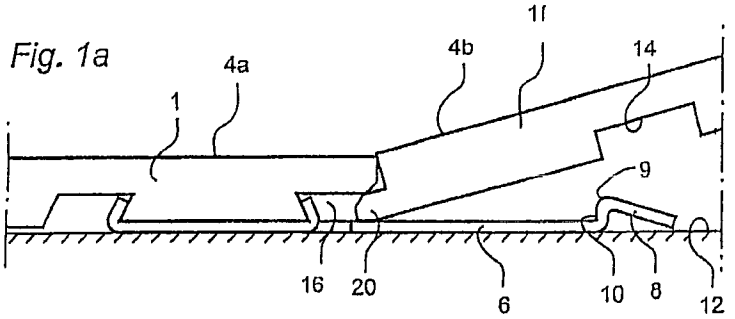
FIGS. 1*a-c* illustrate in different steps mechanical joining of floorboards according to prior art.
Figure 1B:
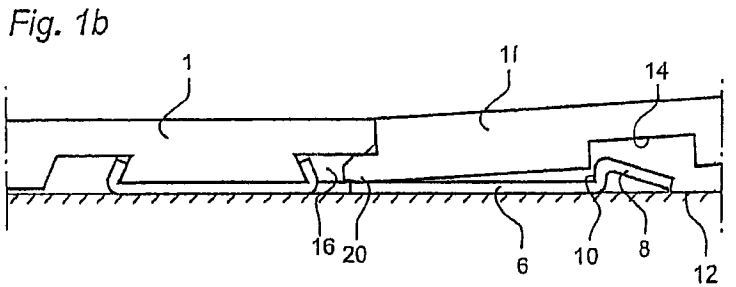
Figure 1C:
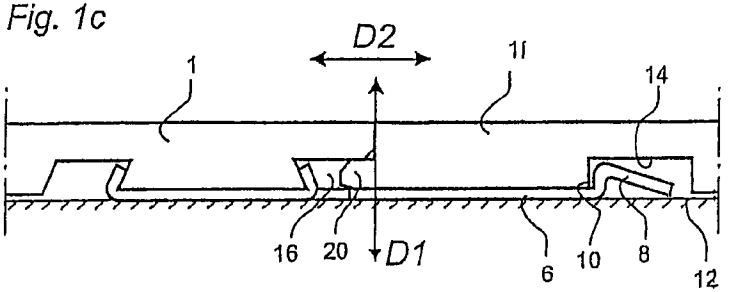
Fig. 1c PRIOR ART
Figure 2A:
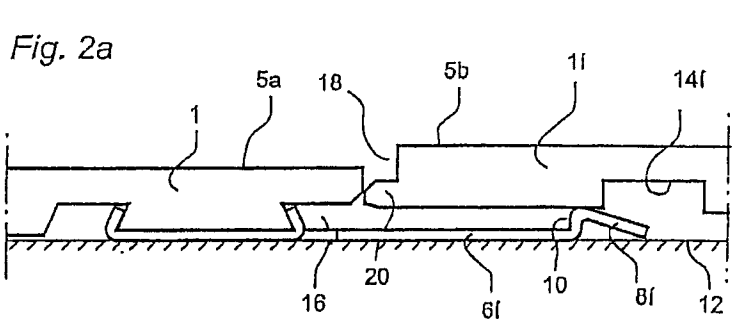
FIGS. 2*a-c* illustrate in different steps mechanical joining of floorboards according to prior art.
Figure 2B:
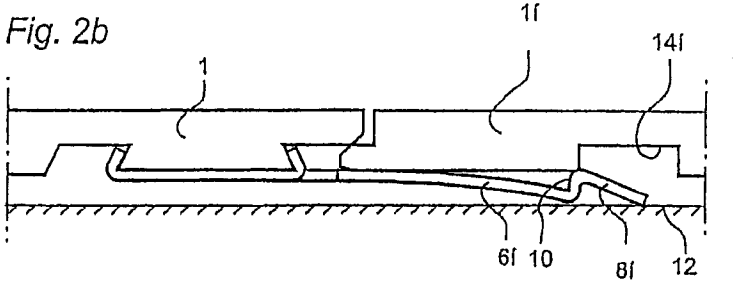
Figure 2C:
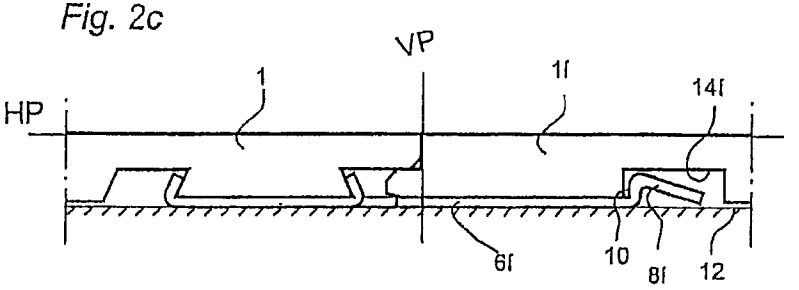
Fig. 2c PRIOR ART
Figure 3A:
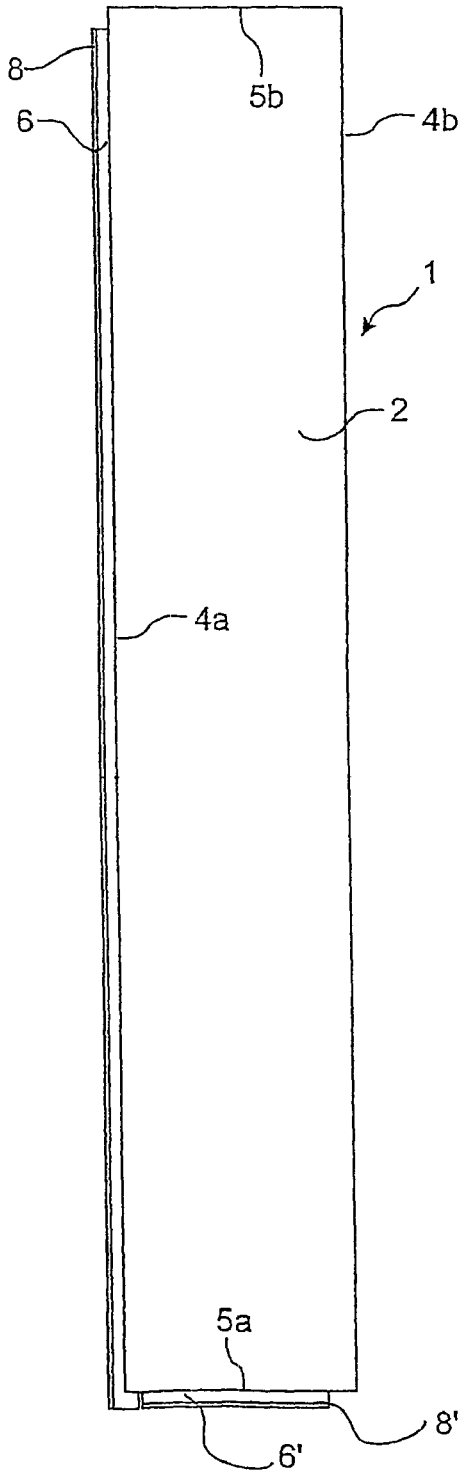
FIGS. 3*a-b* show floorboards with a mechanical locking system according to prior art.
Figure 3B:
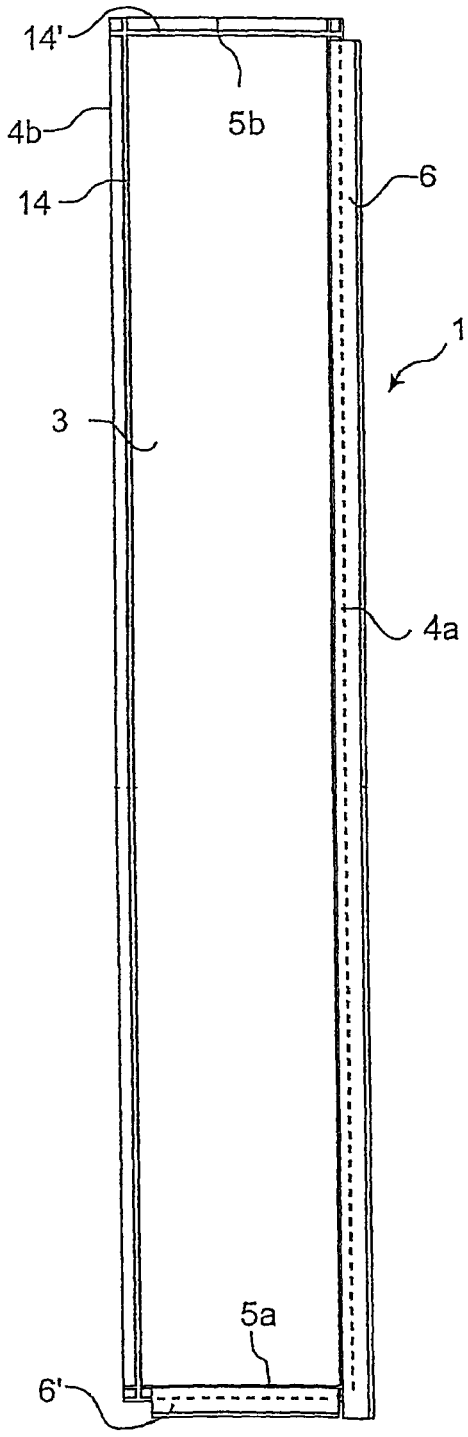
Figure 4A:
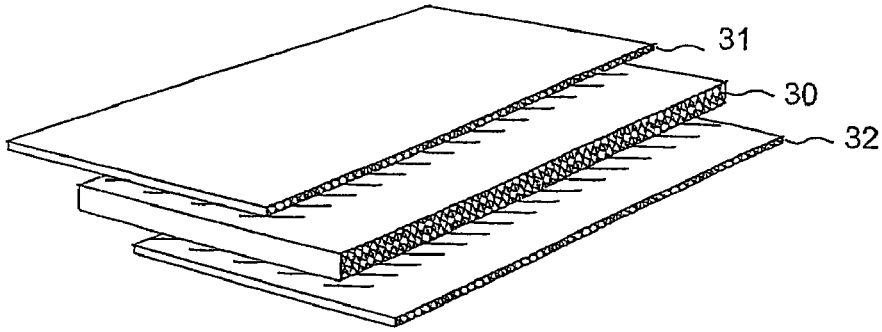
FIGS. 4*a-d* show manufacture of laminate flooring according to prior art.
Figure 4B:
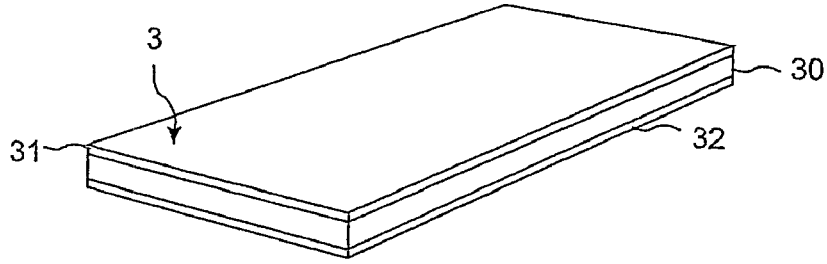
Figure 4C:
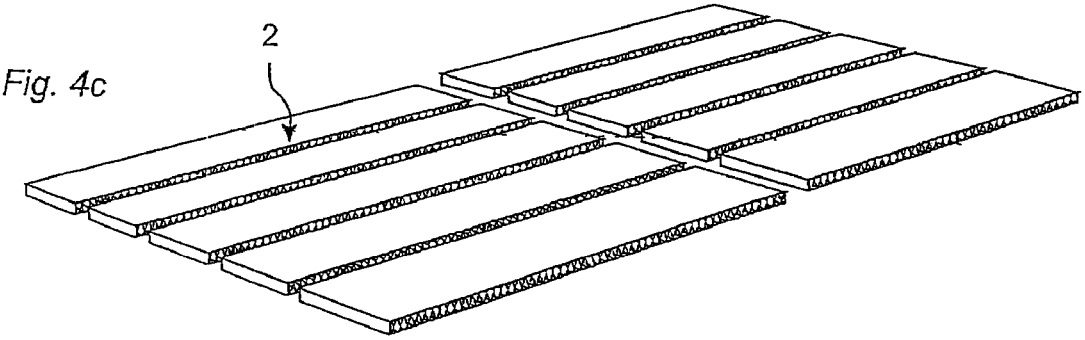
Figure 4D:
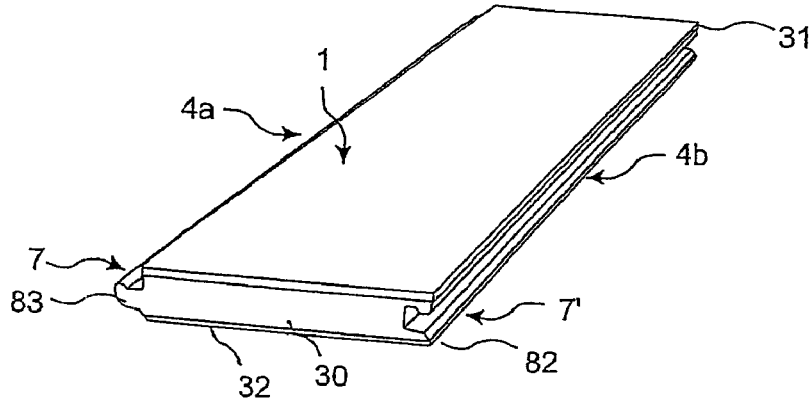
Figure 5A:
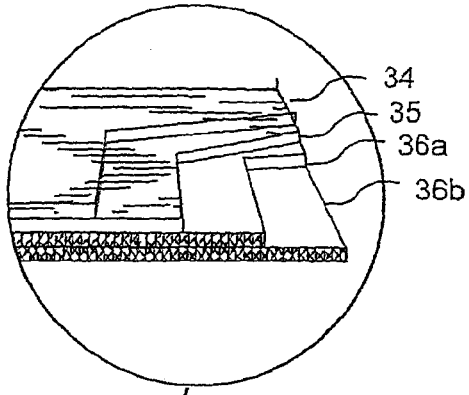
FIGS. 5*a-e* show manufacture of laminate flooring according to prior art.
Figure 5B:
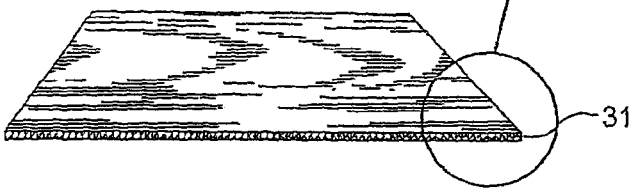
Figure 5C:
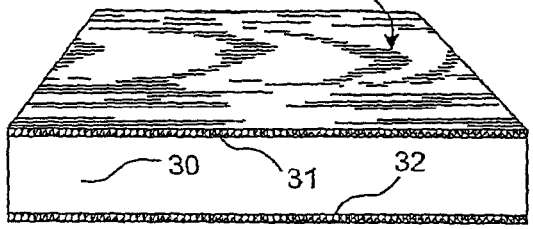
Figure 5D:
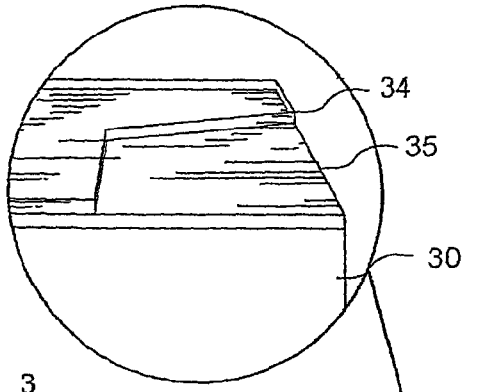
Figure 5E:
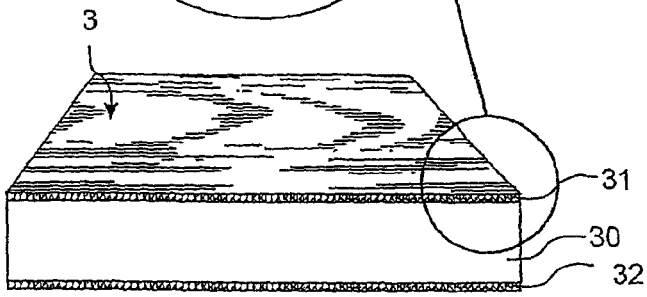
Figure 6A:
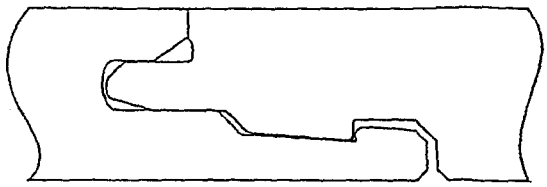
FIGS. 6*a-b* show a mechanical locking system according to prior art.
Figure 6B:
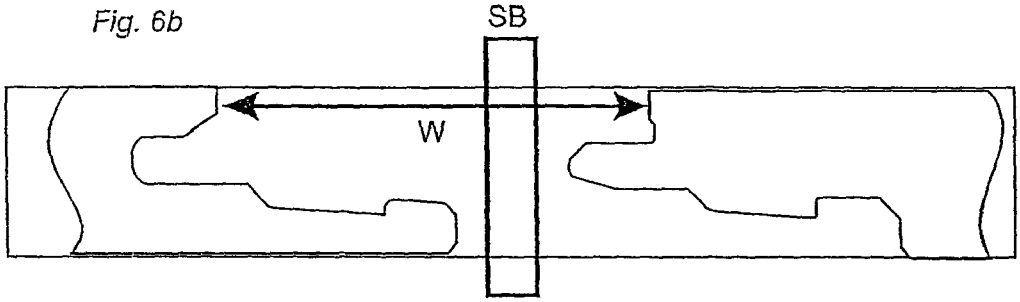
Figure 7A:
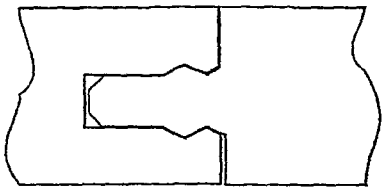
FIGS. 7*a-b* show another mechanical locking system according to prior art.
Figure 7B:
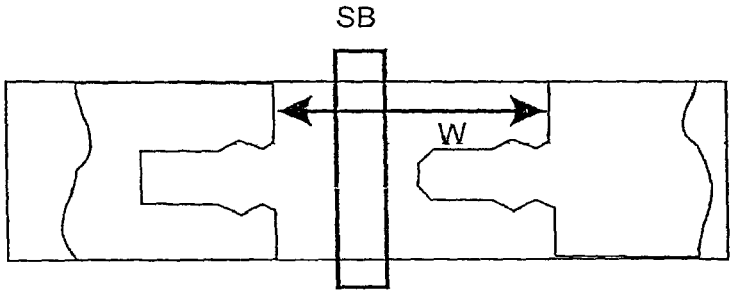
Figure 8A:
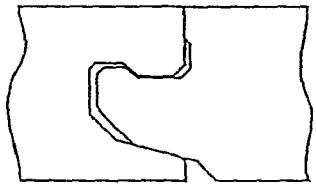
FIGS. 8*a*-8*b* show a third embodiment of mechanical locking systems according to prior art.
Figure 8B:
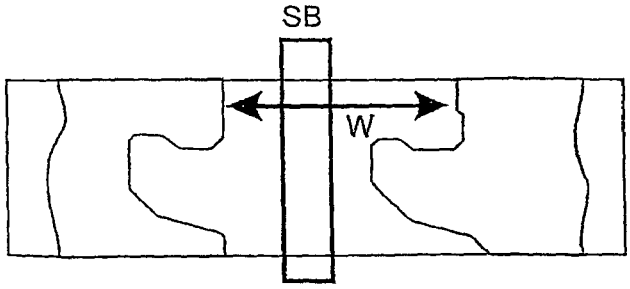
Figure 9A:
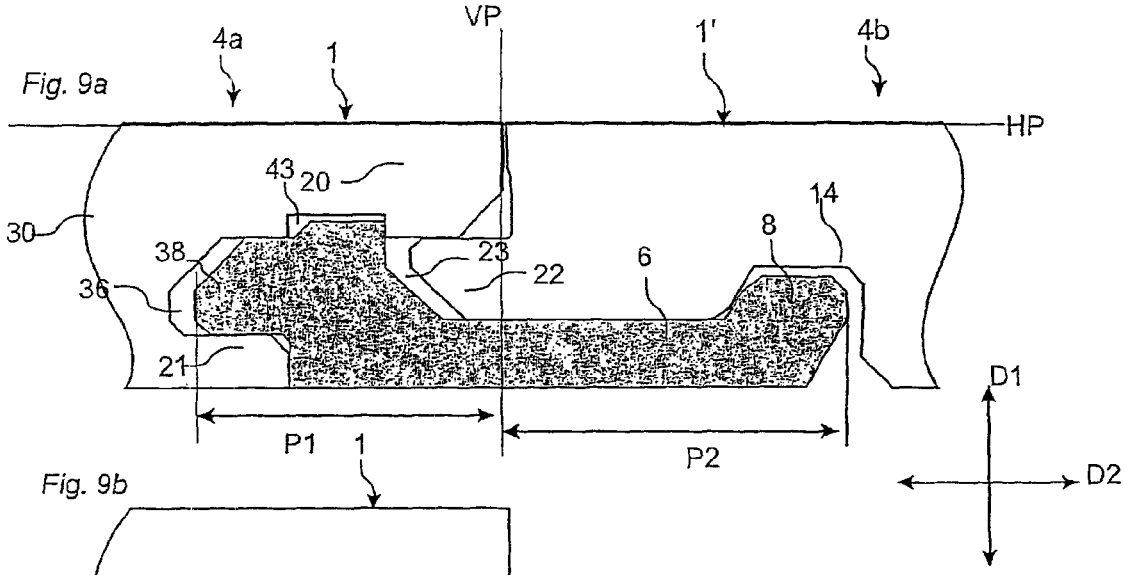
FIGS. 9*a-d* illustrate schematically an embodiment of the invention.
Figure 9B:
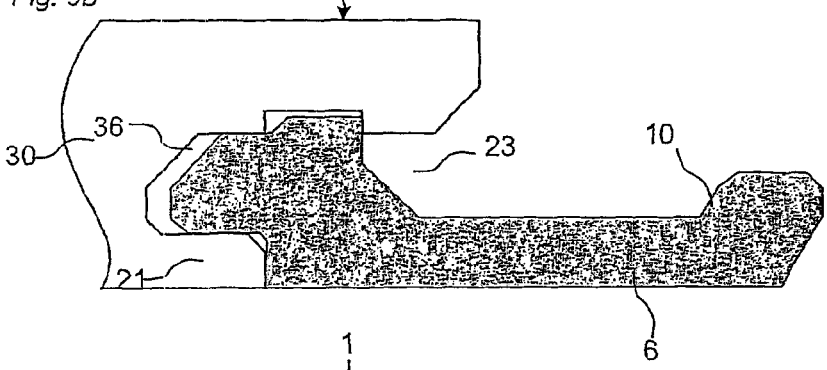

FIG. 9*a* illustrates schematically a cross-section through a joint between a long side edge portion 4*a* of a board 1 and an opposite long side edge portion 4*b* of a second board 1'.

The upper sides of the boards are essentially positioned in a common horizontal plane HP, and the upper parts of the joint edge portions 4*a*, 4*b* abut against each other in a vertical plane VP. The mechanical locking system provides locking of the boards relative to each other in the vertical direction D1 as well as the horizontal direction D2.

To provide joining of the two joint edge portions in the D1 and D2 directions, the edges of the floorboard have in a manner known per se a tongue groove 23 in one edge portion 4*a* of the floorboard and a tongue 22 formed in the other joint edge portion 4*b* and projecting past the vertical plane VP.

In this embodiment, the board 1 has a body or core 30 of wood-fibre-based material.

The mechanical locking system according to the invention comprises a separate strip 6 which has a projecting portion P2 projecting past the vertical plane and having a locking element. The separate strip also has an inner part P1 which is positioned inside the vertical plane VP and is mechanically joined with the floorboard 1. The locking element 8 coacts in prior-art manner with a locking groove 14 in the other joint edge portion and locks the floorboards relative to each other in the horizontal direction D2.

The floorboard 1 further has a strip groove 36 in one joint edge portion 4*a* of the floorboard and a strip tongue 38 in the inner part P1 of the separate strip 6.

The strip groove 36 is defined by upper and lower lips 20, 21 and has the form of an undercut groove 43 with an opening between the two lips 20, 21.

Figure 9C:
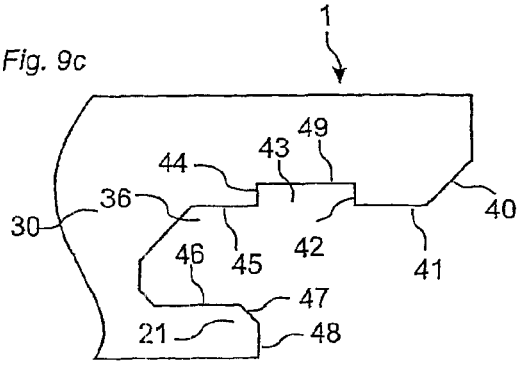

The different parts of the strip groove 36 are best seen in FIG. 9*c*. The strip groove is formed in the body or core 30 and extends from the edge of the floorboard. Above the strip groove there is an upper edge portion or joint edge surface 40 which extends all the way up to the horizontal plane HP. Inside the opening of the strip groove there is an upper engaging or supporting surface 41, which in the case is parallel to the horizontal plane HP. This engaging or supporting surface passes into a locking surface 42. Inside the locking surface there is a surface portion 49 forming the upper boundary of the undercut portion 33 of the strip groove and a surface 44 forming the bottom of the undercut groove. The strip groove further has a lower lip 21. On the upper side of this lip there is an engaging or supporting surface 46. The outer end of the lower lip has a lower joint edge surface 47 and a positioning surface 48. In this embodiment, the lower lip 21 does not extend all the way to the vertical plane VP.

Figure 9D:
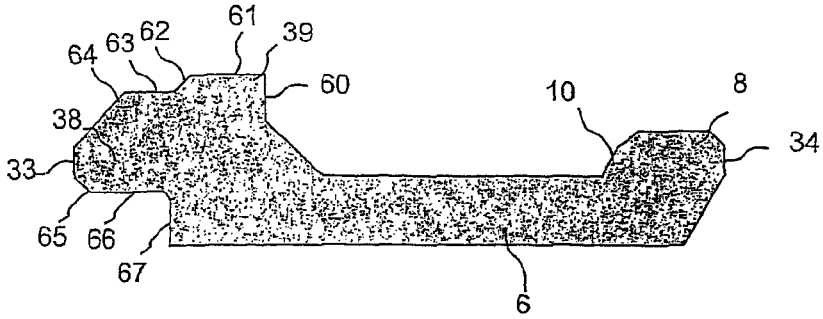

The shape of the strip tongue is also best seen in FIG. 9*d*. In this preferred embodiment, the strip tongue is made of a wood-based board material, for instance HDF.

The strip tongue 38 of the separate strip 6 has a strip locking element 39 which coacts with the undercut groove 43 and locks the strip onto the joint edge portion 4*a* of the floorboard 1 in the horizontal direction D2. The strip tongue 38 is joined with the strip groove by means of a mechanical snap joint. The strip locking element 39 has a strip locking surface 60 facing the vertical plane VP, an upper strip surface 61 and an inner upper guiding part 62 which in this embodiment is inclined. The strip tongue also has an upper engaging or supporting surface 63, which in this case extends all the way to an inclined upper strip tongue part 64 at the tip of the tongue. The strip tongue further has a lower guiding part 65 which in this embodiment passes into a lower engaging or supporting surface 66. The supporting surface passes into a lower positioning surface 67 facing the vertical plane VP. The upper and lower engaging surfaces 45, 63 and 46, 66 lock the strip in the vertical direction D1. The strip 6 is in this embodiment made of a board material containing wood fibres, for instance HDF.

Figure 10A:
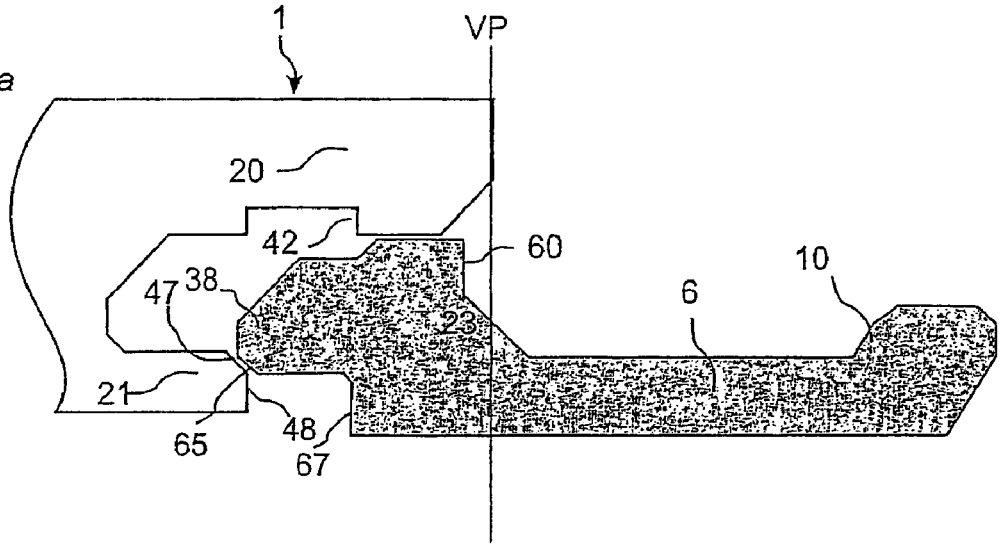
FIGS. 10*a-c* show schematically joining of a separate locking strip with a floorboard according to the invention.
Figure 10B:
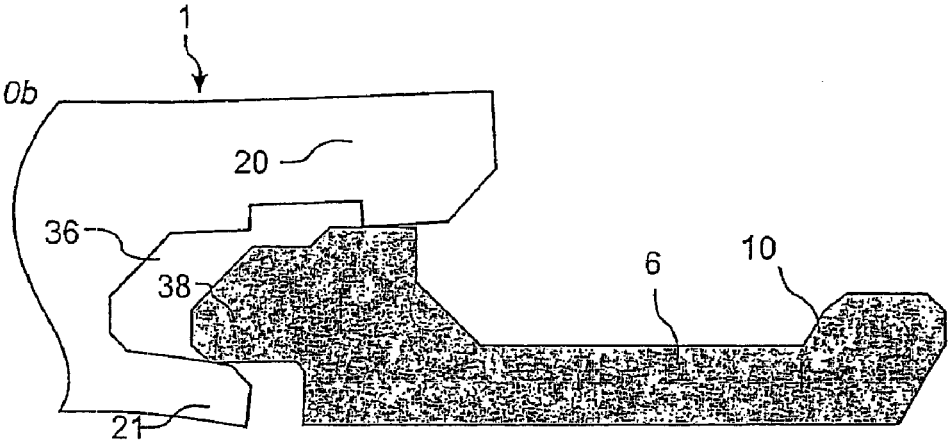
Figure 10C:
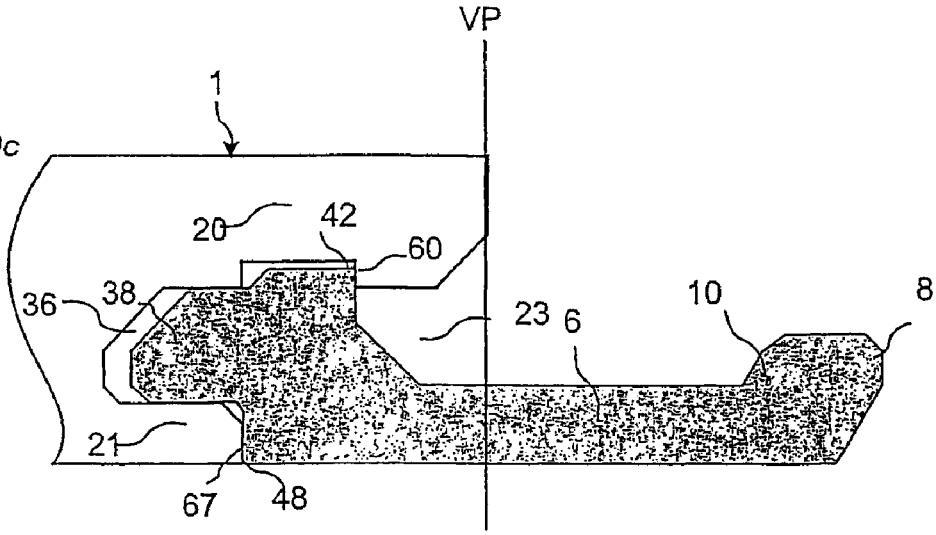

FIGS. 10*a-c* illustrate schematically how the separate strip 6 is integrated with the floorboard 1 by snap action. When the floorboard 1 and the strip 6 are moved towards each other according to FIG. 10*a*, the lower guiding part 65 of the strip tongue will coact with the joint edge surface 47 of the lower lip 21. According to FIG. 10*b*, the strip groove 36 opens by the upper lip 20 being bent upwards and the lower lip 21 downwards. The strip 6 is moved until its positioning surface 67 abuts against the positioning surface 48 of the lower lip. The upper and the lower lip 20, 21 snap backwards and the locking surfaces 42, 60 lock the strip 6 into the floorboard 1 and prevent separation in the horizontal direction. The strip tongue 38 and the strip groove 36 prevent separation in the vertical direction D1. The locking element 8 and its locking surface 10 will by this type of snap motion be exactly positioned relative to the upper joint edge of the floorboard and the vertical plane VP. Thus, by this snap motion the floorboard has been integrated with a machined strip which in this embodiment is made of a separate sheet-shaped and wood-fibre-based material.

Figures 11A, 11B, 11C, 12A, 12B, 12C, 13:
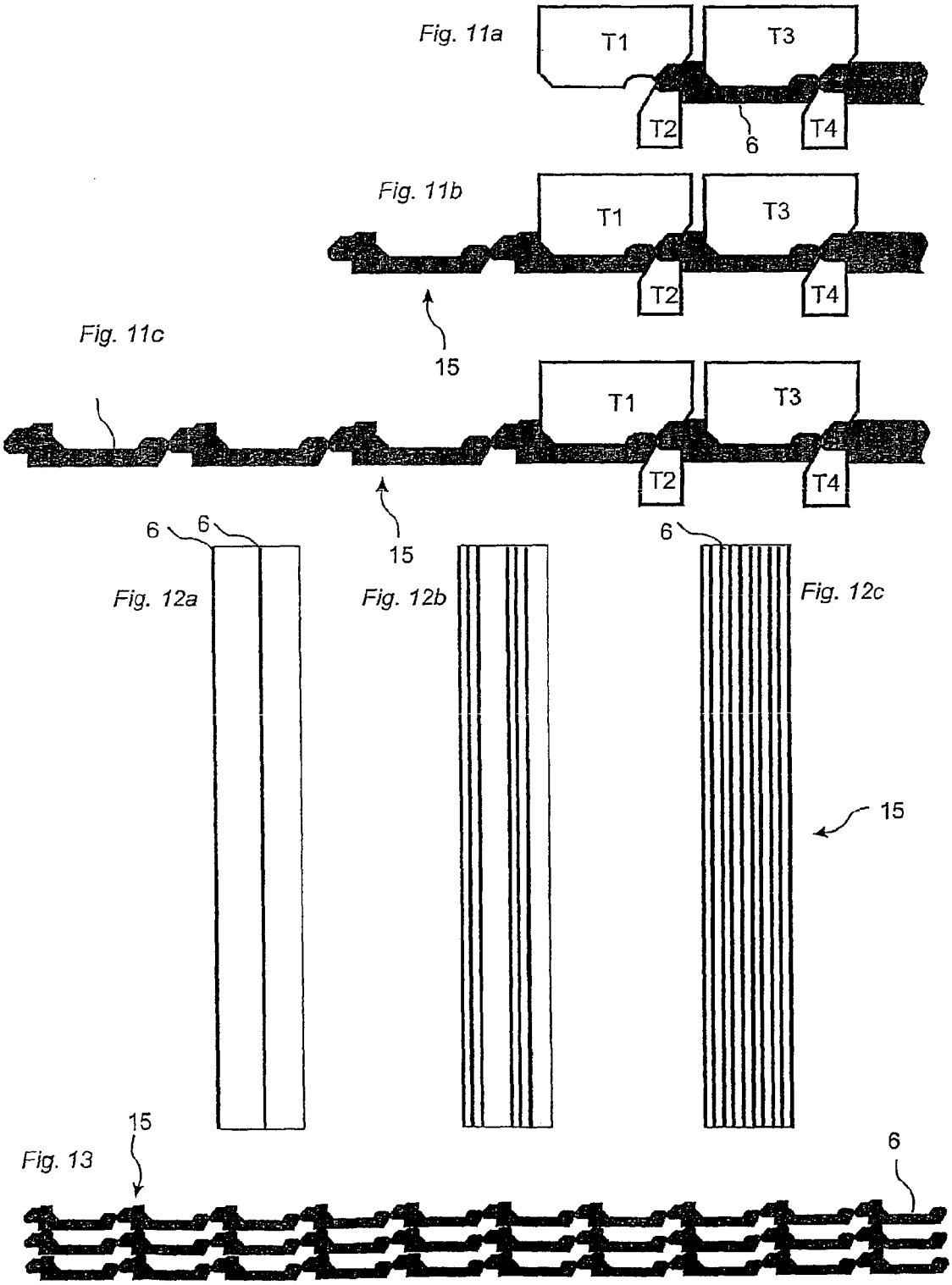
FIGS. 11*a-c* illustrate machining of strip blanks according to the invention.
FIGS. 12*a-c* show how a strip blank is made in a number of manufacturing steps according to the invention.
FIG. 13 shows how a plurality of strip blanks can be handled according to the invention.
Figure 14A:
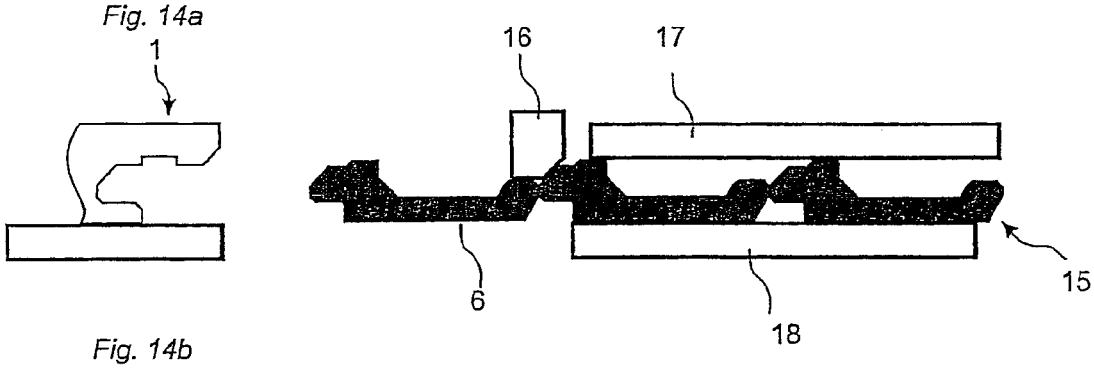
FIGS. 14*a-d* show how the separate strip is joined with the floorboard and separated from the strip blank according to the invention.
Figure 14B:
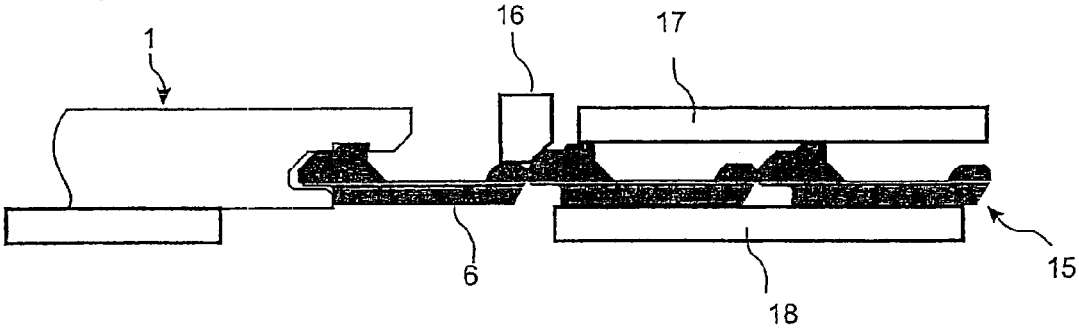
Figure 14C:
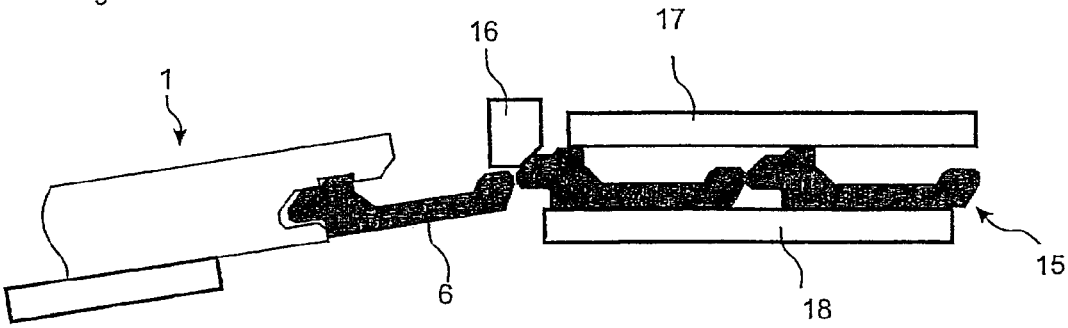
Figure 14D:
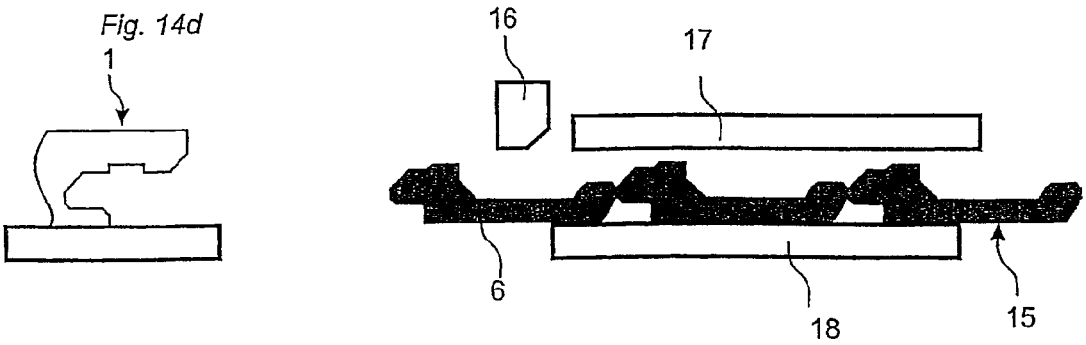

FIGS. 11*a-c* show how a strip blank 15 consisting of a plurality of strips 6 is made by machining. T1-T4 indicate machining tools, preferably of diamond type, operating from above and from below. Only two tools T1 and T2 are necessary to produce a strip 6. In the first manufacturing step according to FIG. 11*a*, a strip 6 is made. However, this strip is not separated from the strip blank. In the next machining, the strip blank 15 is moved sideways a distance corresponding to the width of two strips. In the third manufacturing step, this step is repeated and now two more strips are manufactured. The strip blank thus grows by two strips in each run through the machine. FIGS. 12*a-c* show how the strip blank 15 with a plurality of strips 6 can be manufactured in a double-sided milling machine with four tools on each side. In the first manufacturing step according to FIG. 12*a*, two strips are manufactured. In the next manufacturing step, FIG. 12*b*, four more strips are manufactured. FIG. 12*c* shows that the strip blank consists of 10 strips after three steps. With a double-sided machine, which has, for instance, 8 milling motors and 8 tools on each side, 8 strips can be made in each run through the milling machine. Since machining can take place in e.g. HDF which does not have a surface layer, machining speeds of up to 200 m/min can be achieved with 8 strips in each run. Since normal flooring lines machine the joint edges by about 100 m/min, such a line can provide 16 flooring lines with strip blanks. The strips are made of a board material which can be considerably thinner than the floorboard. The cost of a separate strip with a width of 15-20 mm, made of an HDF board having a thickness of, for instance, 5 mm, is less than 30% of the waste cost in machining an 8 mm laminate floorboard with an integrated strip which has an extent outside the joint edge corresponding to about 8-10 mm.

Several variants may exist. A strip blank can be manufactured in conventional planers. Special machines can be used consisting of e.g. an upper and a lower shaft with tools operating vertically. The floorboard is advanced by means of rolls which press the floorboard against vertical and lateral abutments and against the rotating tools.

An important feature according to the present invention thus is that the separate strip is made by mechanical machining of a sheet-shaped material.

FIG. 13 shows a plurality of strip blanks which can be stacked and handled rationally. It is possible to manufacture strip blanks which are as long as length and width of the floorboard and which consist of 10-12 strip blanks or more. The length of the strips may vary, for instance, between 70 and 2400 mm. The width can be, for instance, about 10-30 mm. The strip blanks can be made with fracture lines for separation of the strips. In HDF, such fracture lines can be made so that the thickness of material amounts to merely, for instance, about 0.5 mm. The strip blanks may then be joined with e.g. strings of hot-melt adhesive to long bands which may then be rolled up.

FIGS. 14*a-d* show a manufacturing method for integrating the strip with the floorboard. The strip blank 15 is fed between upper and lower supports 17, 18 towards a stop member 16 so that the strip 6 will be correctly positioned. The floorboard 1 is moved towards the strip according to FIG. 14*b* so that snapping-in takes place. Then the strip 6 is separated from the strip blank 15, for instance, by the strip being broken off. Subsequently this manufacturing step is repeated according to FIG. 14*d*. The equipment required for this snapping-in is relatively simple, and manufacturing speeds corresponding to normal flooring lines can be obtained. The strip 6 can in this manner be snapped onto both long side and short side. It is obvious that a number of variants of this manufacturing method are feasible. The strip 6 can be moved towards the floorboard at different angles. Snapping-in can be combined with an angular motion. Inward angling with a minimum, or no, snapping-in may also be used. Inward angling to a state of friction or even pretension between the respective locking surfaces of the strip and the floorboard may be used. The strip may be attached when the board stands still or when it is moving. In the latter case, part of the strip is pressed against the joint edge portion of the floorboard adjacent to a corner between a long side and a short side. Then the remaining part of the strip can be rolled, pressed or angled towards the joint edge. Combinations of one or more of these methods may be used within one side or between different sides. The strip can be separated in a number of other ways, for instance, by cutting off, sawing etc, and this can also take place before fastening.

Figure 15A:
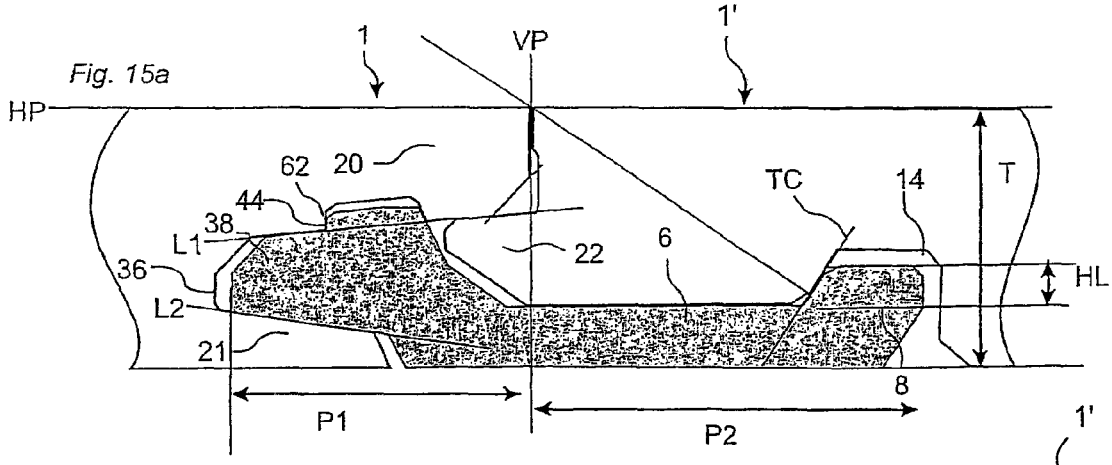
Figure 15B:
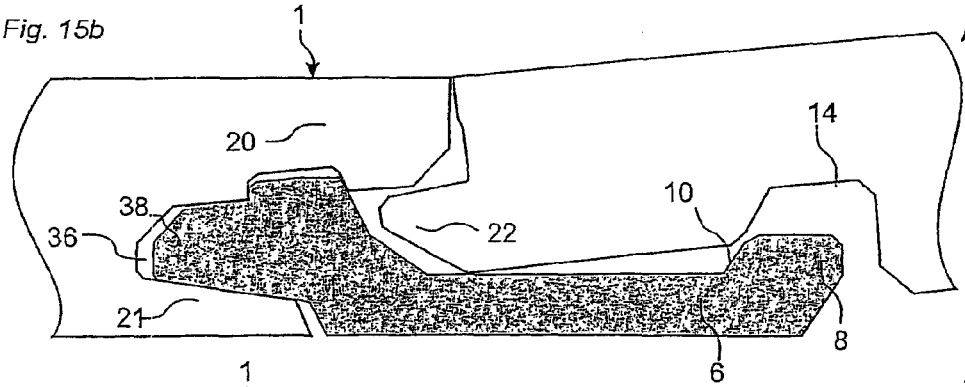
Figure 15C:
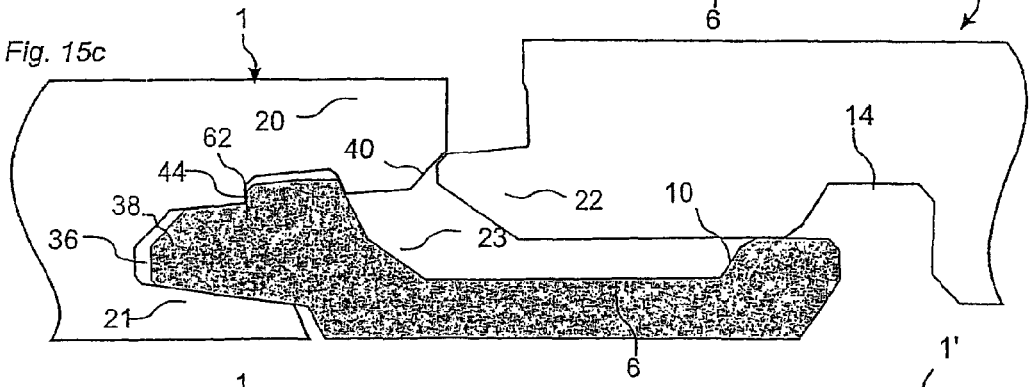
Figure 15D:
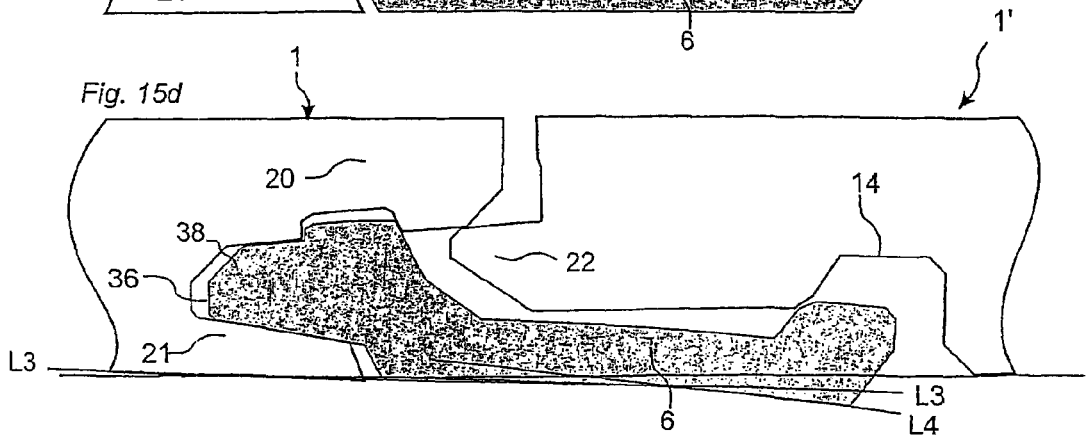
Figure 16A:
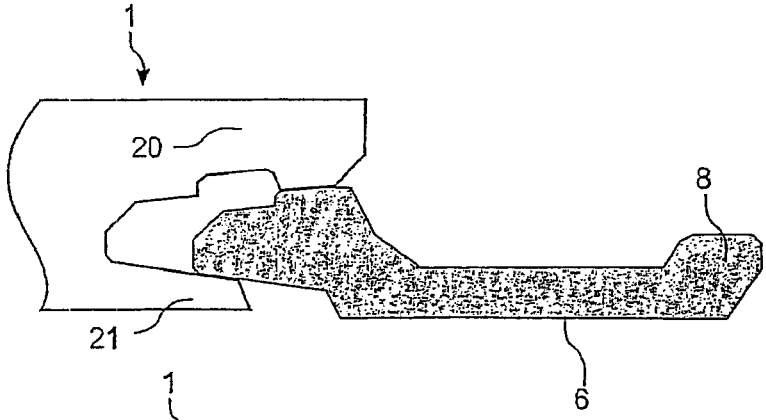
FIGS. 16*a-d* show joining of a production-adjusted separate strip blank with the floorboard by snap action according to the invention.
Figure 16B:
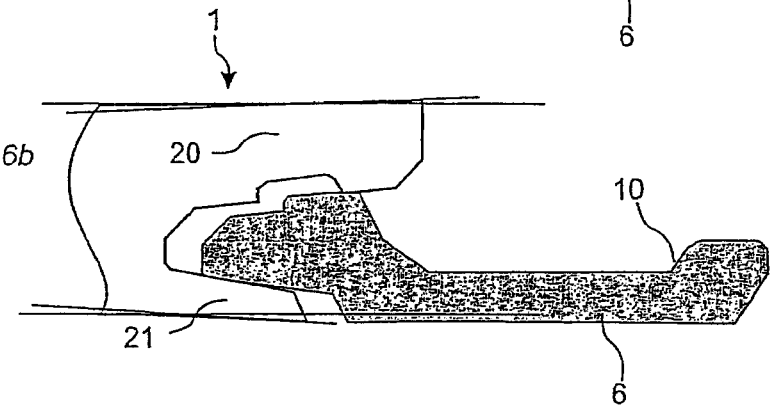
Figure 16C:
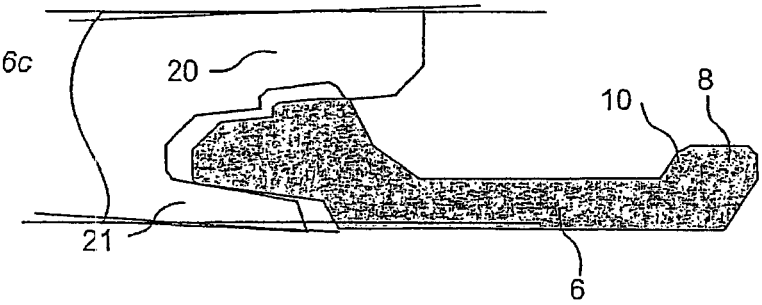
Figure 16D:
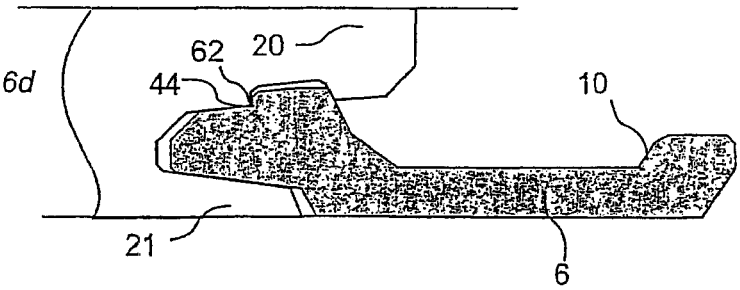

FIGS. 15*a-d* show a production-adjusted variant of the invention. In this embodiment, the upper and lower lips 20, 21 of the strip groove 36 as well as the upper and lower engaging surfaces 63, 66 of the strip tongue are inclined relative to the horizontal plane HP and they follow lines L1 and L2. This significantly facilitates snapping the strip into the floorboard 1. The lower lip 21 has been made longer and the locking element of the strip and the locking surface of the undercut groove are inclined. This facilitates manufacture and snapping-in. In this embodiment, the positioning of the strip in connection with snapping-in takes place by part of the upper guiding part 62 coacting with the bottom 44 of the undercut groove. The locking element 14 has a locking surface 10 which has the same inclination as the tangent TC to the circular arc with its centre in the upper joint edge. Such an embodiment facilitates inward angling but requires that the projecting portion P" should have an extent which is preferably the same size as the thickness T of the floorboard for the locking surface of the locking element to have a sufficiently high angle relative to the underside of the board. A high locking angle increases the locking capability of the locking system. The separate strip allows joint geometries with an extended projecting portion P2 without this causing greater costs in manufacture. An extended inner part P1 facilitates integration by snap action and results in high fastening capability. The following ratios have been found particularly favourable. P2>T and P1>0.5T. As a non-limiting example it may be mentioned that a satisfactory function can already be achieved when P2 is 0.8*T or larger. FIG. 15*b* shows inward angling with a play between the locking element 8 and the locking groove 14 during the initial phase of the inward angling when the upper joint edges touch each other and when parts of the lower part of the locking groove 14 are lower than the upper part of the locking element 8. FIG. 15*d* shows snapping-in of the floorboard 1' into the floorboard 1. A separate strip 6 which is mechanically integrated with the floorboard 1 facilitates snapping-in by the strip 6 being able to move in a rotary motion in the strip groove 36. The strip can then turn as indicated by line L3. The remaining displacement downwards of the locking element 8 to the position L4 can be effected in prior-art manner by downward bending of the strip 6. This makes it possible to provide locking systems which are capable of snapping and angling on long side as well as short side and which have a relatively high locking element 8. In this way, great strength and good capability of inward angling can be combined with the snap function and a low cost. The following ratio has been found favourable. HL>0.15 T. This can also be combined with the above ratios.

FIGS. 16*a-d* show snapping-in of the strip 6 in four steps. As is evident from the Figures, the inclined surfaces allow the snapping-in of the strip 6 into the floorboard 1 to be made with a relatively small bending of the upper and lower lips 20 and 21.

Figure 17:
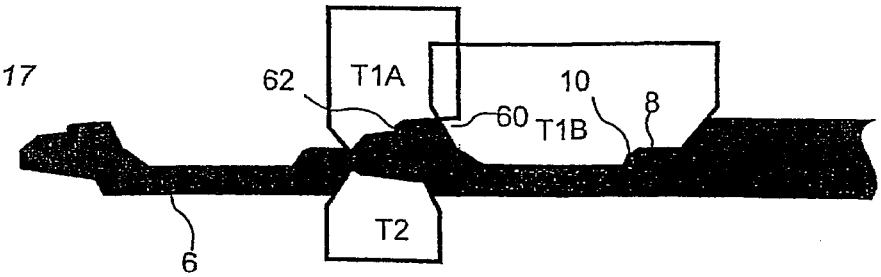
FIG. 17 illustrates a preferred alternative of how the separate strip is made by machining according to the invention.
Figure 18A:
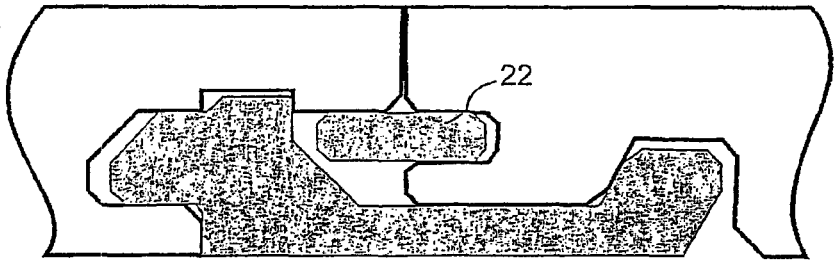
FIGS. 18*a-d* illustrate a preferred embodiment according to the invention with a separate strip and tongue.
Figure 18B:
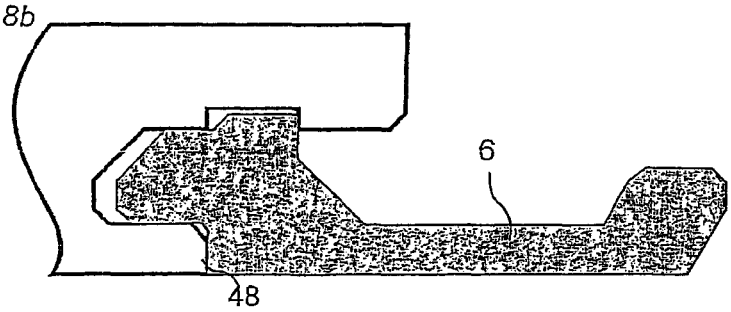
Figure 18C:
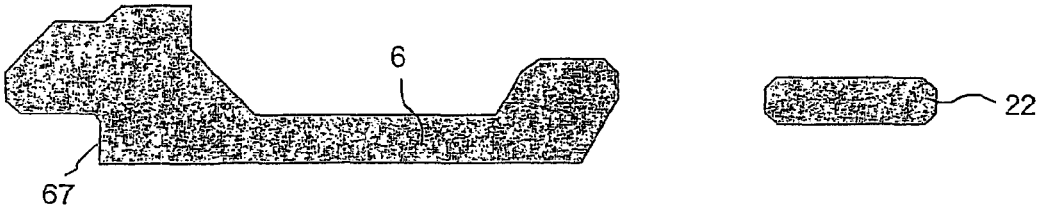
Figure 18D:
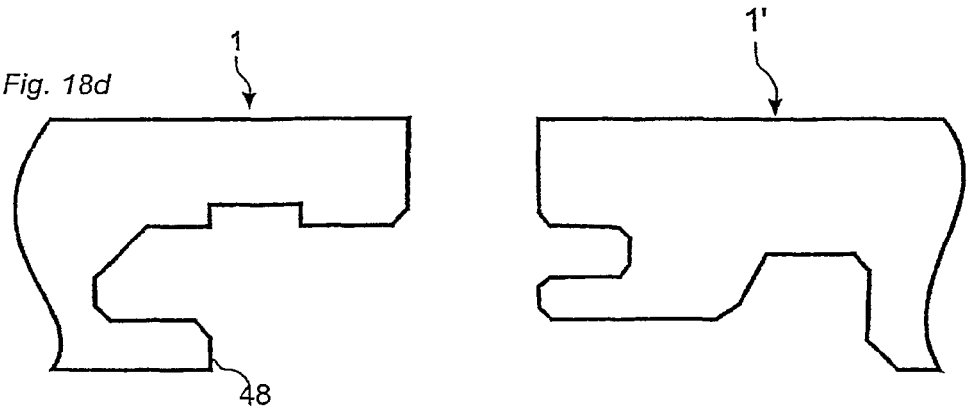
Figure 19A:
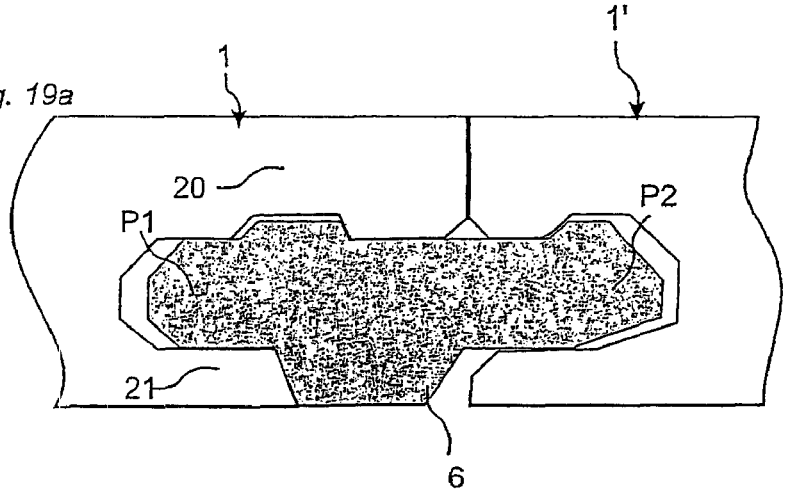
FIGS. 19*a-d* illustrate a preferred embodiment according to the invention.
Figure 19B:
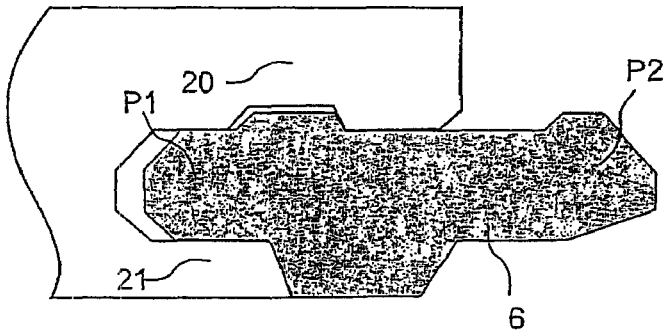
Figure 19C:
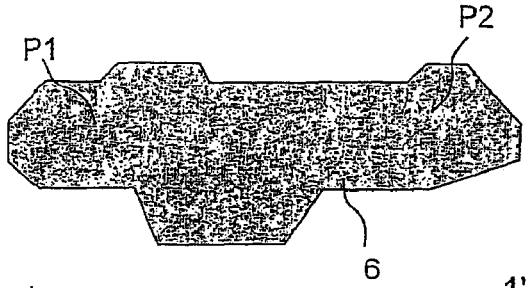
Figure 19D:
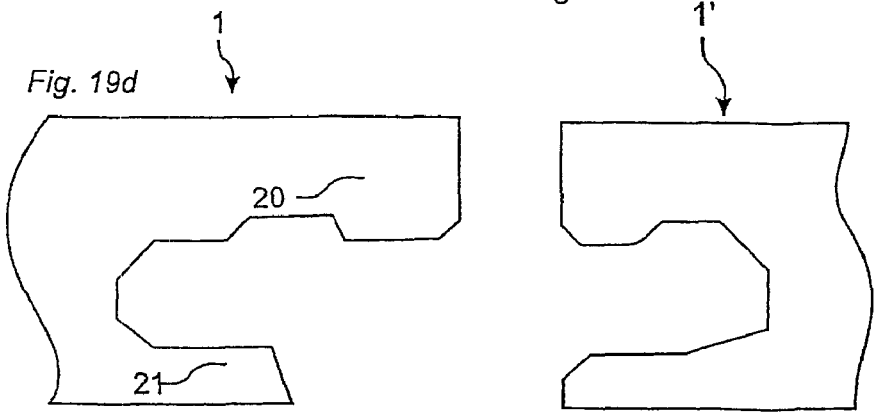
Figure 20A:
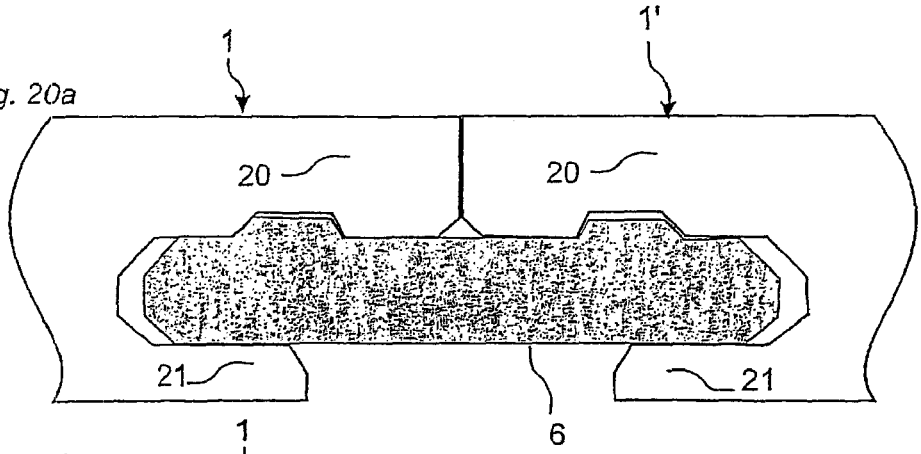
FIGS. 20*a-e* illustrate a preferred embodiment according to the invention with a separate strip having symmetric edge portions.
Figure 20B:
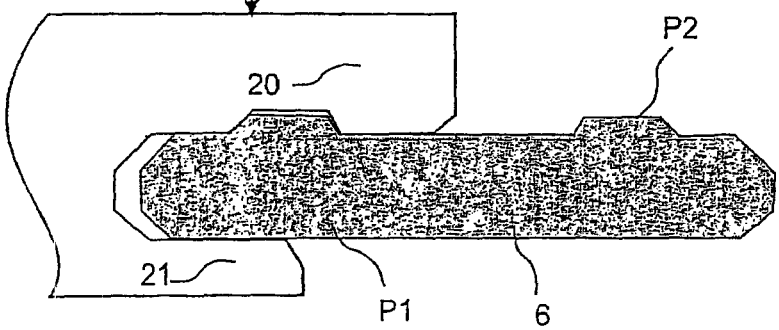
Figure 20C:
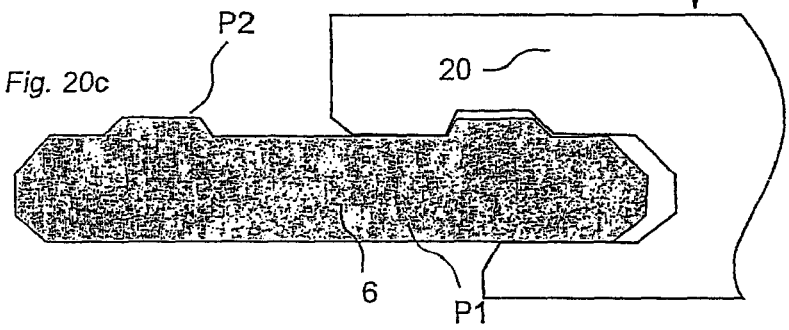
Figure 20D:
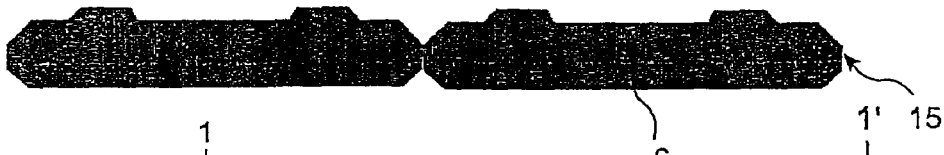
Figure 20E:
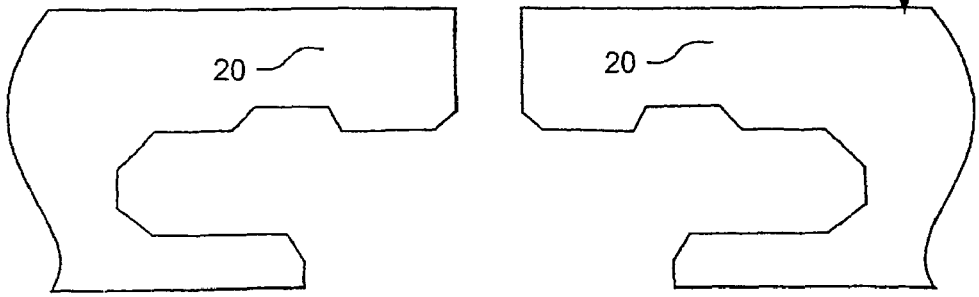

FIG. 17 shows manufacture of a strip blank where all three critical locking and positioning surfaces are made using a divided tool which contains two adjustable tool parts T1A and T1B. These tool parts are fixed in the same tool holder and driven by the same milling motor. This divided tool can be ground and set with great accuracy and allows manufacture of the locking surfaces 10 and 60 as well as the positioning surface 62 with a tolerance of a few hundredths of a millimetre. The movement of the board between different milling motors and between different manufacturing steps thus does not result in extra tolerances.

FIGS. 18*a-d* show an embodiment of the invention where also the tongue 22 is made of a separate material. This embodiment can reduce the waste still more. Since the tongue locks only vertically, no horizontal locking means other than friction are required to fasten the tongue in the floorboard 1'.

FIGS. 19*a-d* show another embodiment of the invention which is characterised in that the projecting portion has a locking element which locks in an undercut groove in the board 1'. Such a locking system can be locked by angling and snapping and it can be unlocked by upward angling about the upper joint edge. Since the floorboard 1' has no tongue, the amount of wasted material can be minimised.

FIGS. 20*a-e* show an embodiment of the invention which is characterised in that the separate strip 6 consists of two symmetric parts, and that the joint portions of the floorboards 1, 1' are identical. This embodiment allows simple manufacture of, for instance, boards which may consist of A and B boards which have mirror-inverted locking systems. The locking system of the preferred geometry is not openable. This can be achieved, for instance, by rounding of the lower and outer parts of the strip 6.

Figure 21:
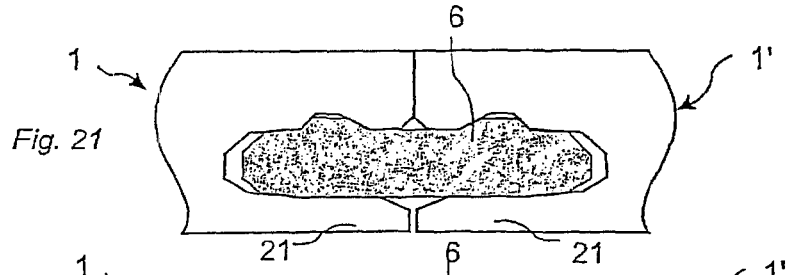
FIGS. 21-26 show examples of different embodiments according to the invention.

FIGS. 21-26 illustrate variants of the invention. FIG. 21 shows an embodiment with lower lips 21 which extend essentially to the vertical plane.

Figure 22:
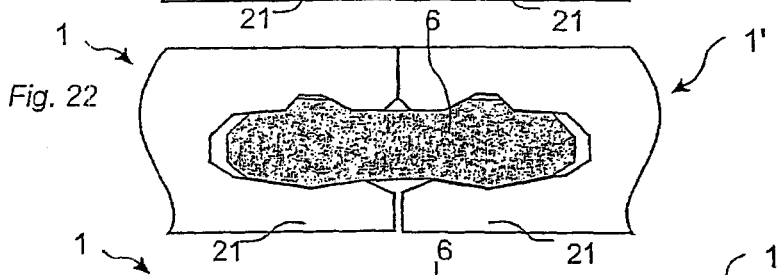

FIG. 22 shows an embodiment with locking elements on the upper and lower sides of the strip 6.

Figure 23:
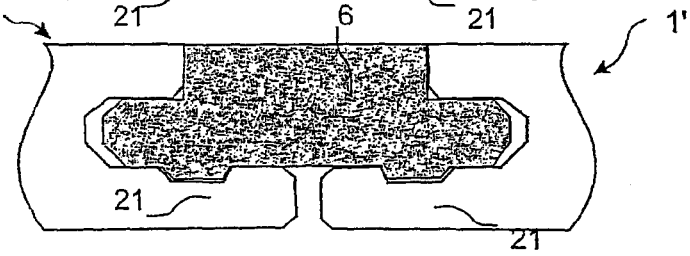

FIG. 23 shows a separate strip which is visible from the surface and which may constitute a decorative joint portion. An HDF strip can be coloured and impregnated. A strip of e.g. compact laminate can have a decorative surface part which is moisture proof and has high wearing strength. The strip can be provided with a rubber coating counteracting penetration of moisture. Preferably the strip should be attached to the long side only and preferably in such a manner that part of the strip projects from the surface at the short sides of the floorboard. This attachment should be made after machining of the long side but before machining of the short side. The surplus material can then be removed in connection with machining of the short sides and the strip will have a length corresponding to the length of the surface layer. Decorative strips can be made without visible joints. The strip-locking elements are in this embodiment positioned in the lower lip 21.

Figure 24:
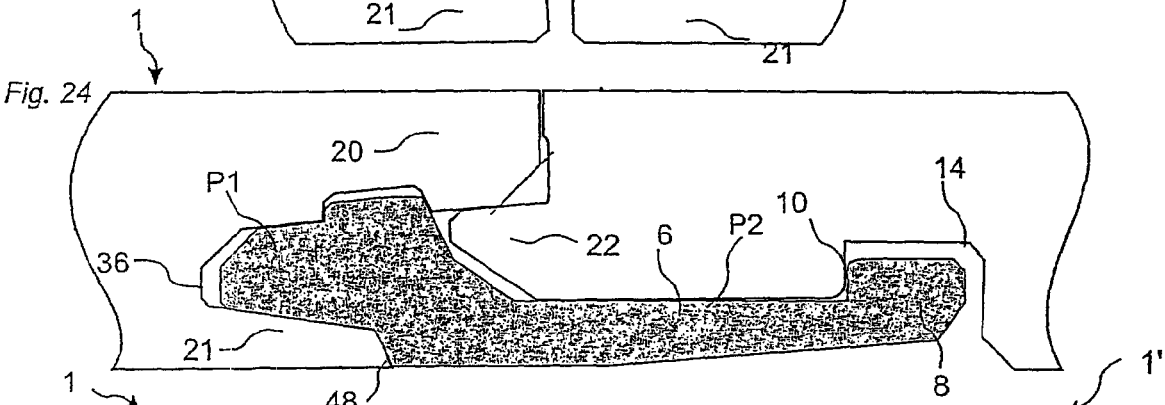

FIG. 24 shows a separate strip with a tapering projecting portion which improves the flexibility of the strip.

Figure 25:
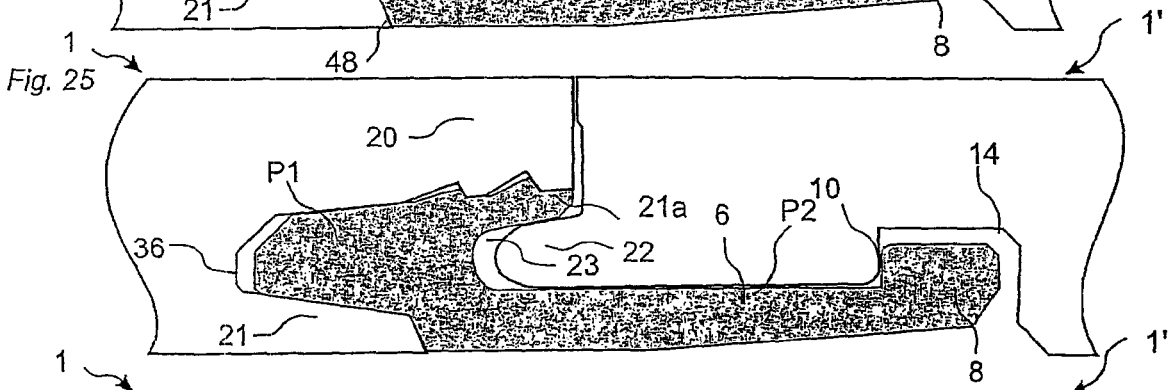

FIG. 25 shows an embodiment where the inner portion P1 of the strip has a strip groove 36. This may facilitate snapping-in of the strip since also the strip groove 36 is resilient by its lip 21*a* also being resilient. The strip groove can be made by means of an inclined tool according to prior art. This embodiment is also characterised in that the inner portion P1 has two locking elements.

Figure 26:
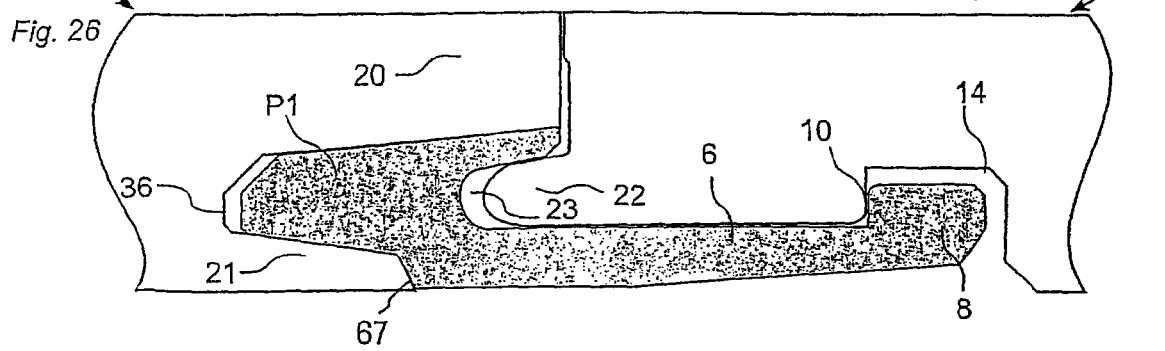

FIG. 26 shows an embodiment where the inner portion P1 has no locking element. The strip 6 is inserted into the strip groove until it abuts against the lower positioning surface and is retained in this position by frictional forces. Such an embodiment can be combined with gluing which is activated in a suitable prior-art manner by heating, ultrasound etc. The strip 6 can be preglued before being inserted.

Figure 27A:
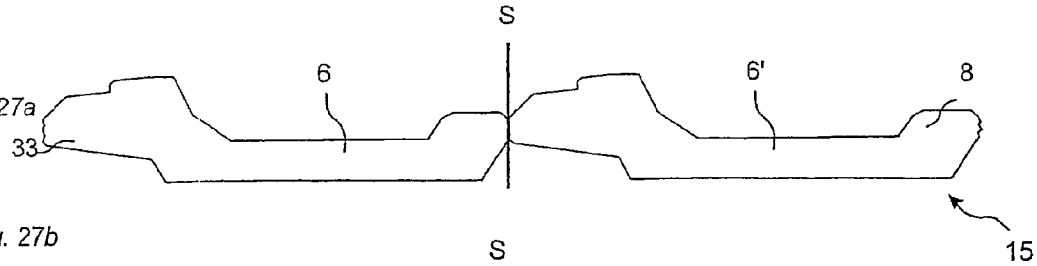
FIGS. 27*a-b* show examples of how the separate strip according to the invention can be separated from the strip blank.
Figure 27B:
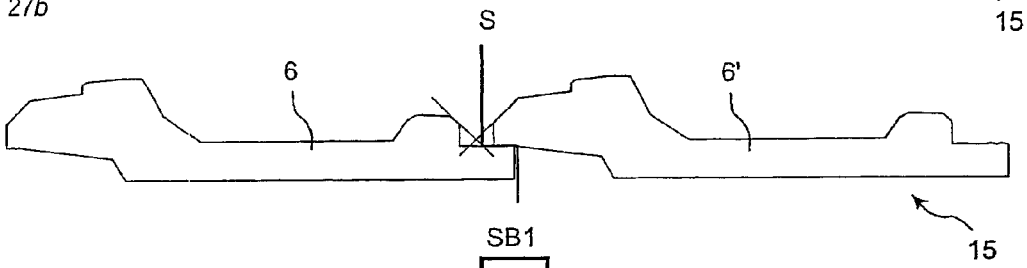

FIGS. 27*a* and *b* show two variants which facilitate separation by the strip 6 being separated from the strip 6' by being broken off. In FIG. 27*a*, the strip 6 is designed so that the outer part of the strip tongue 33 is positioned on the same level as the rear part of the locking element 8. Breaking-off takes place along line S. FIG. 27*b* shows another variant which is convenient especially in HDF material and other similar materials where the fibres are oriented essentially horizontally and where the fracture surface is essentially parallel to the horizontal plane HP. Breaking-off takes place along line S with an essentially horizontal fracture surface.

Figure 28A:
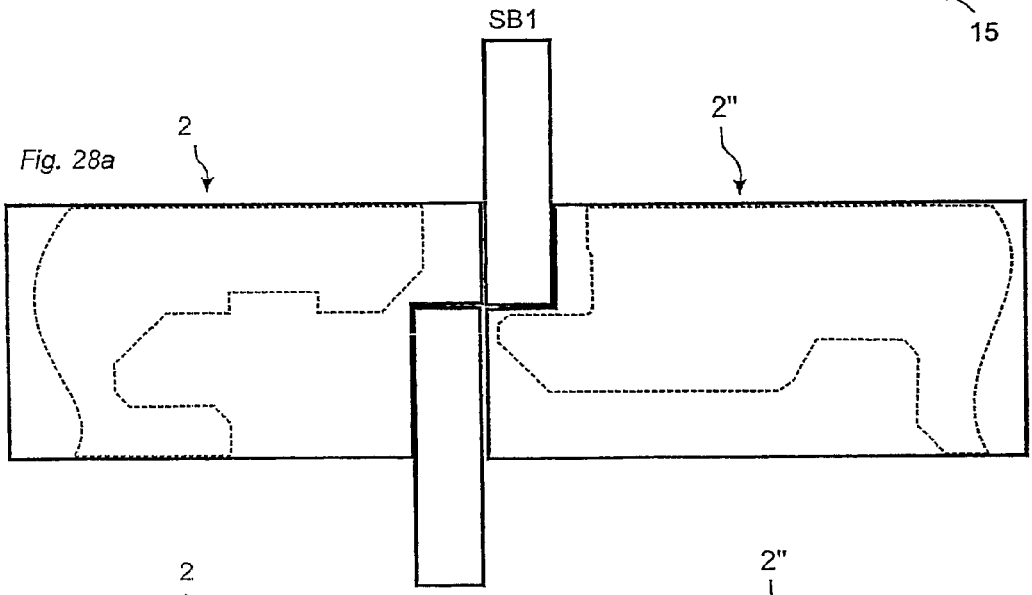
FIGS. 28*a-b* show how sawing of floor elements into floor panels can take place according to the invention so as to minimise the amount of wasted material.
Figure 28B:
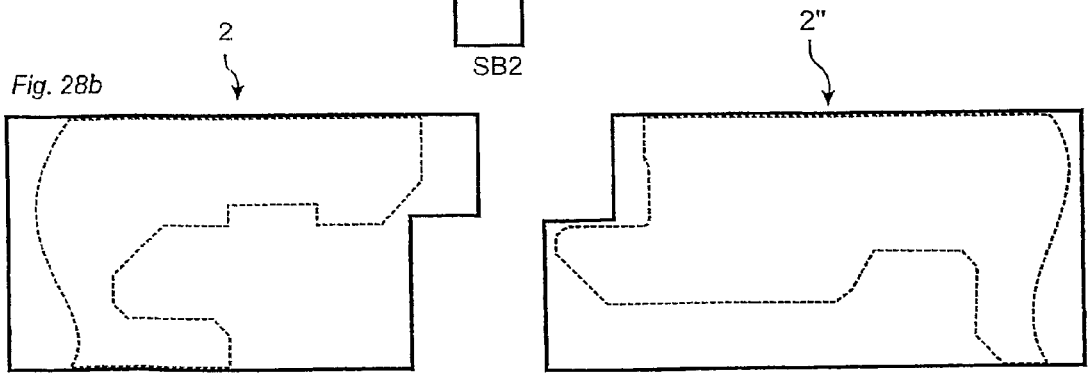

FIGS. 28*a* and *b* show how the amount of wasted material can be minimised in embodiments of the invention where the joint edge is formed with a tongue. Sawing can take place with an upper sawblade SB1 and a lower sawblade SB2 which are laterally offset. The floor elements 2 and 2' will only have an oversize as required for rational machining of the joint edges without taking the shape of the tongue into consideration. By such an embodiment, the amount of wasted material can be reduced to a minimum.

Figure 29A:
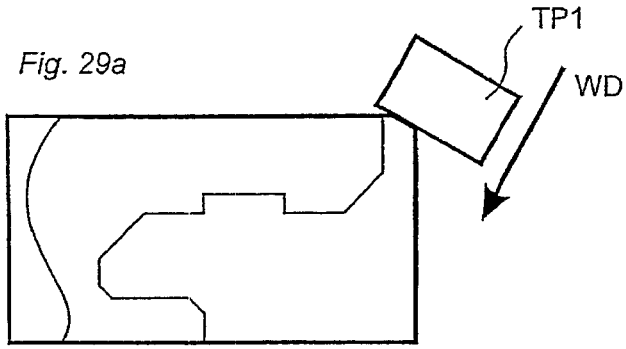
FIGS. 29*a-e* show machining of joint edge portions according to the invention.
Figure 29B:
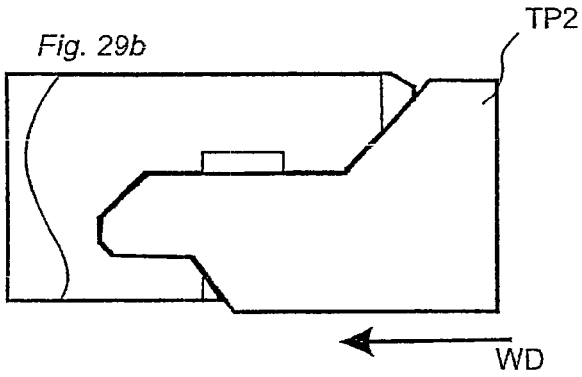
Figure 29C:
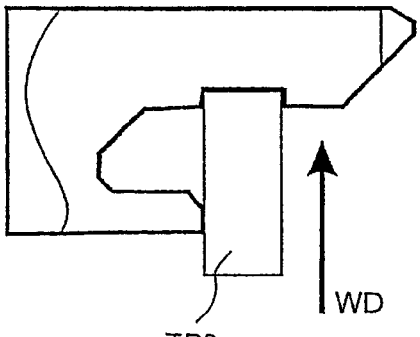
Figure 29E:
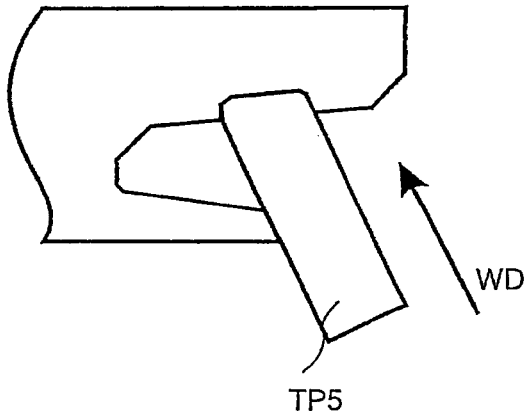
Figure 29D:
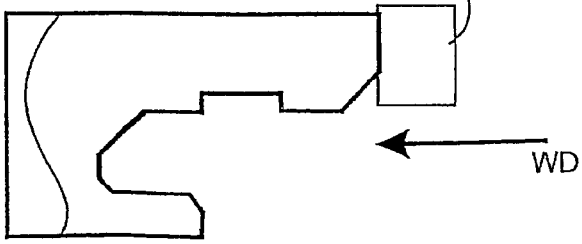

FIGS. 29*a*-*e* show machining of joint edge portions using diamond cutting tools. A tool TP1 with engaging direction WD machines the laminate surface in prior-art manner and performs premilling. A minimum part of the laminate surface is removed. According to FIG. 29*b*, the strip groove is made and the tool TP2 operates merely in the core material and the rear side. FIG. 29*c* shows how the undercut groove with the locking surface and an upper and a lower positioning surface are formed. All critical surfaces that are essential for the horizontal positioning and locking of the strip can thus be formed with great accuracy using one and the same tool. FIG. 29*e* shows how the corresponding machining can be carried out using an inclined tool TP5. Finally the upper joint edge is machined by means of the tool TP4 in prior-art manner. The joint geometry and the manufacturing methods according to the invention thus make it possible to manufacture floorboards with advanced locking systems. At the same time machining of the joint edges can be carried out using fewer tools than normal, with great accuracy and with a minimum amount of wasted material. Wooden flooring does not require a premilling tool TP1 and machining may therefore take place using three tools only. This method thus makes it possible to provide a locking system with a wood-fibre-based strip which extends past the vertical plane while at the same time the manufacture of said locking system at the groove/strip side can take place inside the vertical plane. The method thus combines the advantages of an inexpensive and projecting wood fibre strip and manufacture that does not need to remove large parts of the difficult surface layer.

Figure 30:
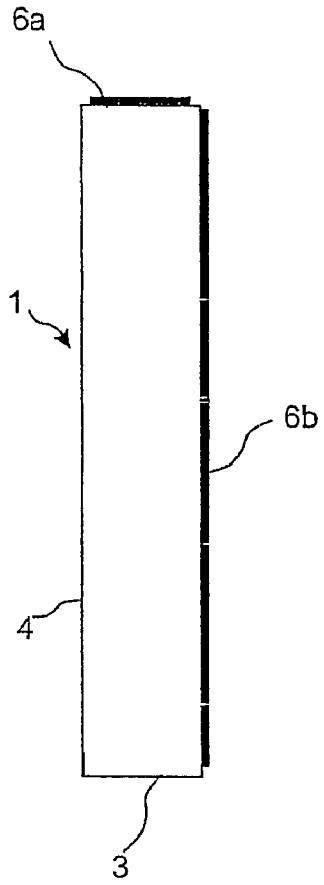
FIG. 30 shows a format corresponding to a normal laminate floorboard with a separate strip on long side and short side according to the invention.
Figure 31:
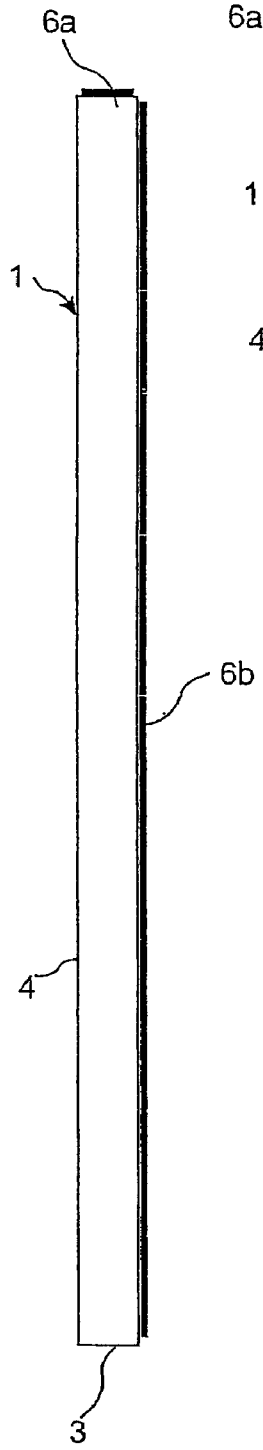
FIG. 31 shows a long and narrow floorboard with a separate strip on long side and short side according to the invention.

FIG. 30 illustrates a normal laminate floorboard with strips 6*b* and 6*a* according to the invention on a long side 4 and a short side 3. The strips can be of the same material and have the same geometry but they may also be different. The invention gives great possibilities of optimising the locking systems on the long side and short side as regards function, cost and strength. On the short sides where the strength requirements are high and where snapping-in is important, advanced, strong and resilient materials such as compact laminate can be used. In long and narrow formats, the long side contains essentially more joint material, and therefore it has been necessary in traditional locking systems to reduce the extent of the strip outside the joint edge as much as possible. This has made snapping-in difficult or impossible, which is an advantage in certain laying steps where inward angling cannot take place. These limitations are largely eliminated by the present invention. FIG. 31 shows a long and narrow floorboard which necessitates a strong locking system on the short side. The saving in material that can be made using the present invention in such a floorboard is considerable.

Figure 32A:
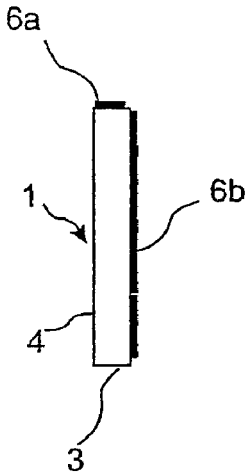
FIGS. 32*a-b* show formats corresponding to a parquet block in two mirror-inverted embodiments with a separate strip on long side and short side according to the invention.
Figure 32B:
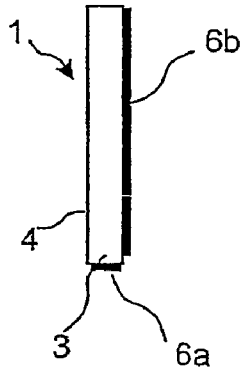

FIGS. 32*a*-*b* show formats resembling parquet blocks. A mechanical locking system of a traditional type can in such a format, for instance 70*400 mm, cause an amount of wasted material of more than 15%. Such formats are not available on the market as laminates. According to the present invention, these formats can be manufactured rationally with a mechanical locking system which is less expensive than also traditional systems using tongue, groove and glue. They can also, as shown in these two Figures, be manufactured with a mirror-inverted system where the strip on the short side is alternately snapped into the upper and lower short sides.

Figure 33:
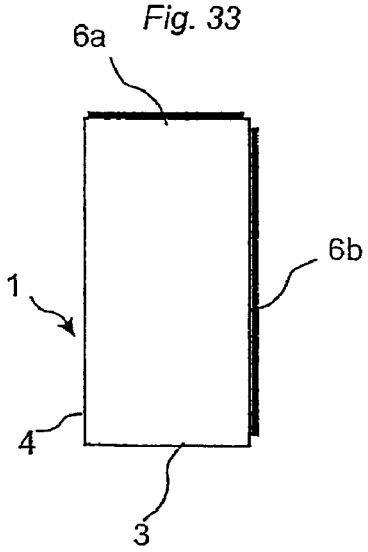
FIG. 33 shows a format which is suitable for imitating stones and tiles with a separate strip on long side and short side according to the invention.

FIG. 33 shows a format with a wide short side. Such a format is difficult to snap in since downward bending of the long strip 6*a* on the short side means that a great bending resistance must be overcome. According to the present invention, this problem is solved by the possibility of using flexible materials in the separate strip which also according to the description above can be made partially turnable in the inner portion.

Figure 33A:
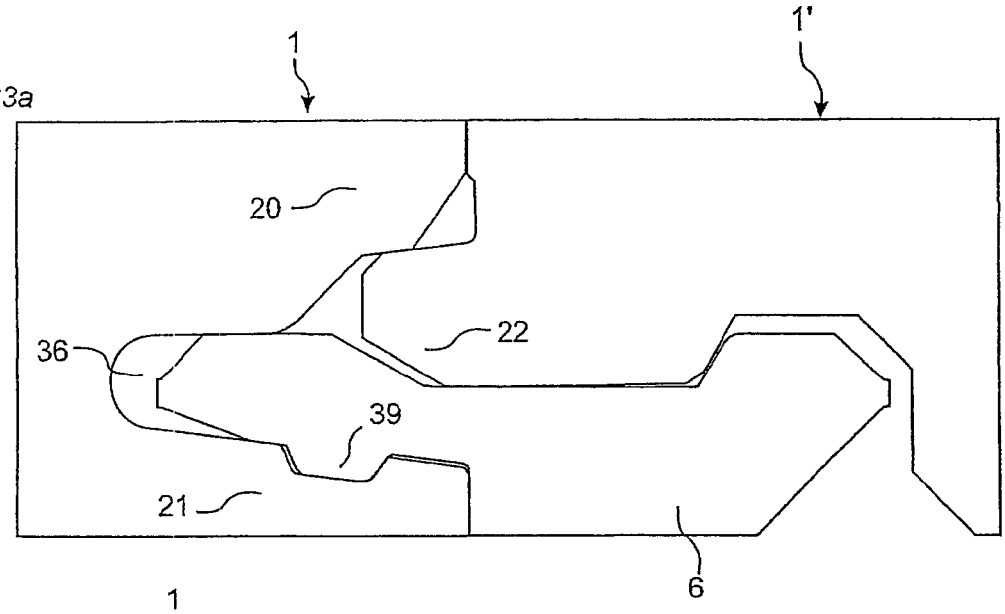
FIGS. 33*a-c* show an embodiment with a separate strip which is locked mechanically in the lower lip and which is joined by a combination of snapping-in and inward angling relative to the joint edge.
Figure 33B:
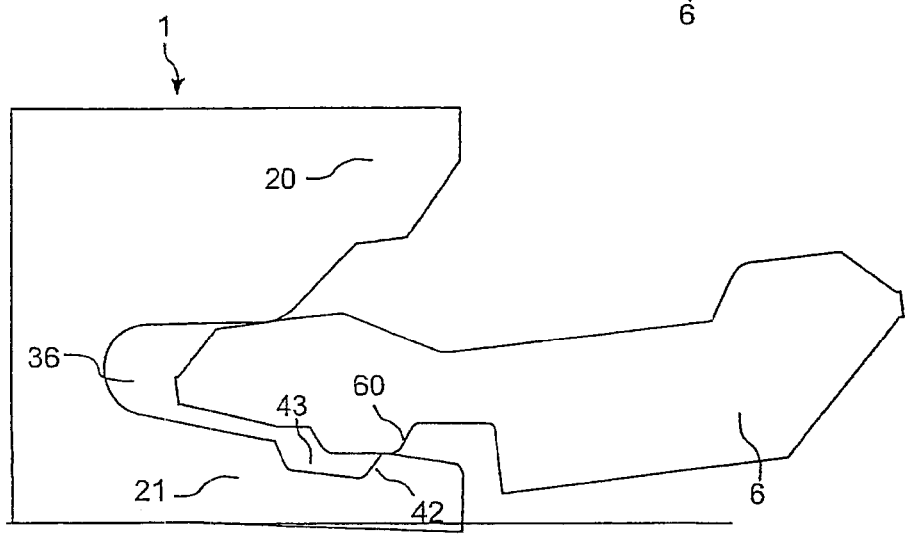
Figure 33C:
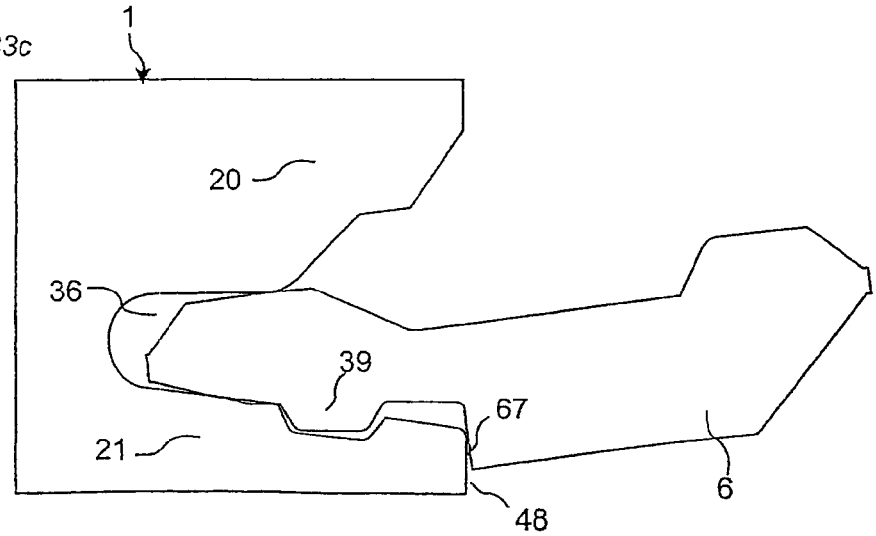

FIGS. 33*a*-*c* show a production-adjusted embodiment with a separate strip 6 which has cooperating horizontal locking surfaces 60, 42 in the lower lip 21. FIGS. 33*b* and *c* show how the strip is snapped on in a somewhat angled position. Snapping-in can take place with downward bending of the lower lip 21 which can be limited to, for instance, half the height of the strip-locking element 39. Thus the lower lip can be relatively rigid, which prevents snapping-out in case of tensile load. An advantage of this embodiment is also that when the floorboards 1, 1' are joined and subjected to tensile load, the tongue 22 will prevent the strip 6 from sliding upwards. In this embodiment the strip will have a stronger attachment when the floorboards are joined than in the case where the floorboards are unmounted. The strip 6 can also easily be taken up by upward angling and this is an advantage when floorboards are laid against a wall in the first or last row.

Figure 34A:
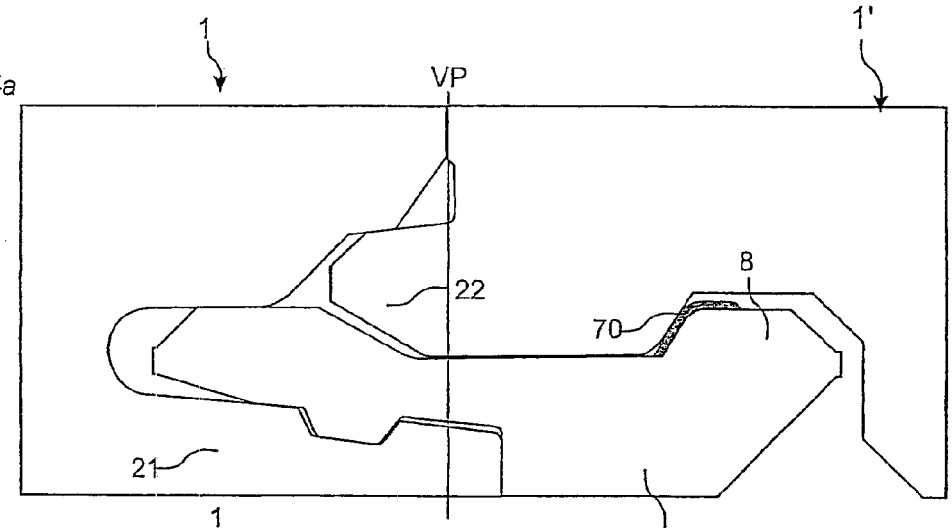
FIGS. 34*a-c* show variants with the strip locked in the lower lip.
Figure 34B:
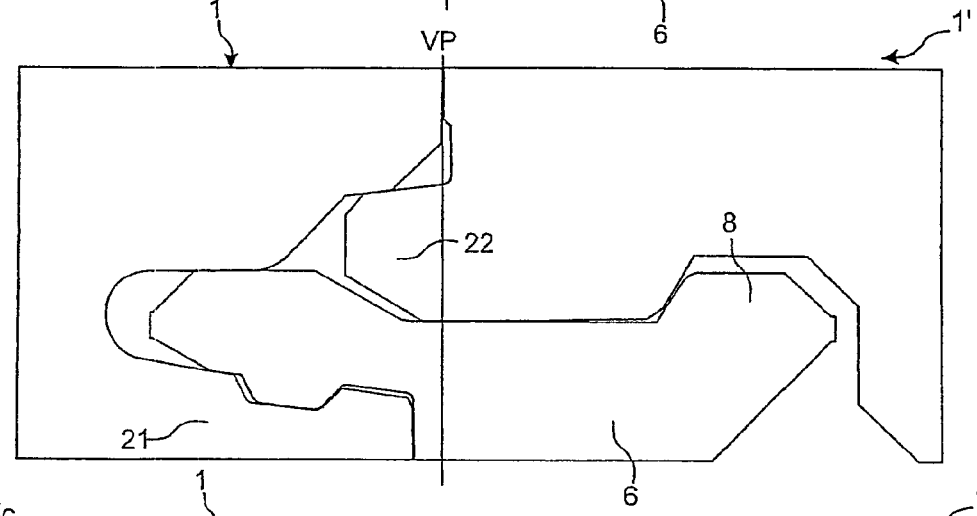
Figure 34C:
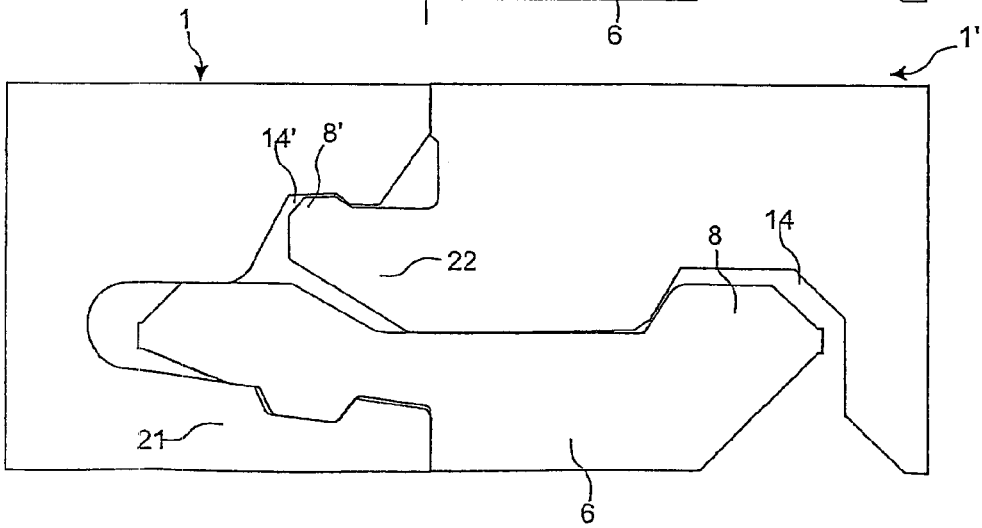

FIGS. 34*a*-34*c* show different embodiments with the lower lip outside and inside the vertical plane VP. The embodiment in FIG. 34*a* can be applied to the short side when the projecting lower lip effects strong locking between the lower lip and the locking strip 6 while at the same time the loss of material is of limited extent. FIG. 34*c* shows a strong locking system with double horizontal locking means 14, 8 and 14', 8'. The separate strip 6 allows the undercut locking groove 14' to be made in a simple manner using large rotating tools since in connection with this manufacture there is no strip 6 at the joint edge portion.

Figure 35A:
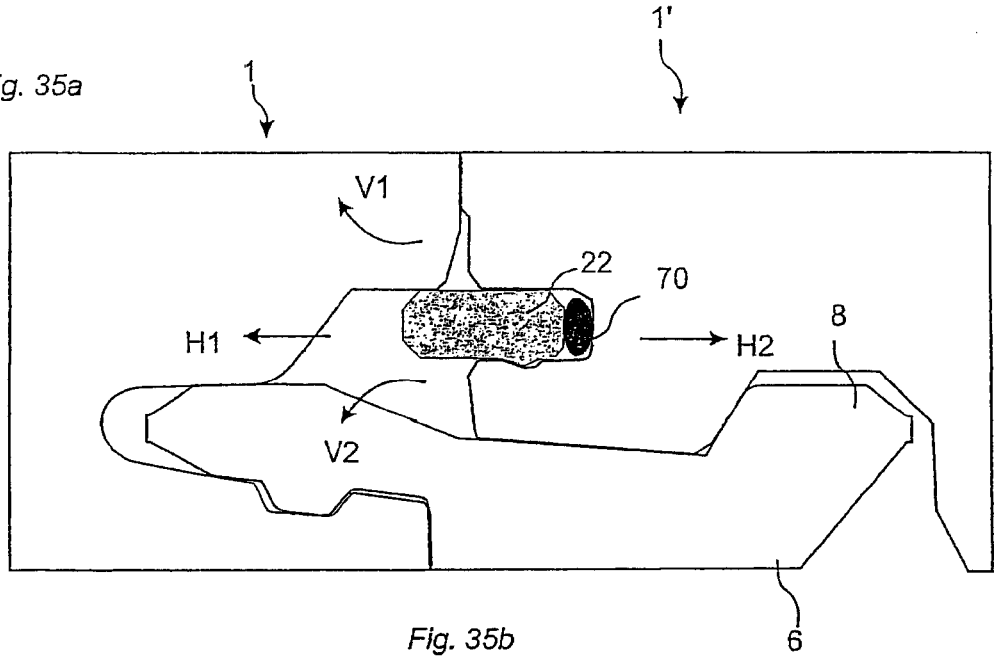
FIGS. 35*a-e* show an embodiment with a separate flexible tongue and taking-up of a floorboard.
Figure 35B:
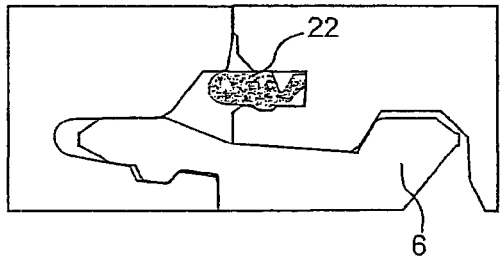
Figure 35C:
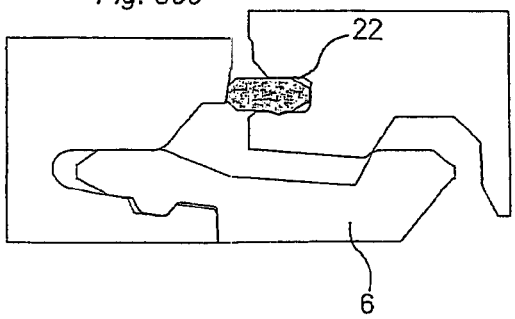
Figure 35D:
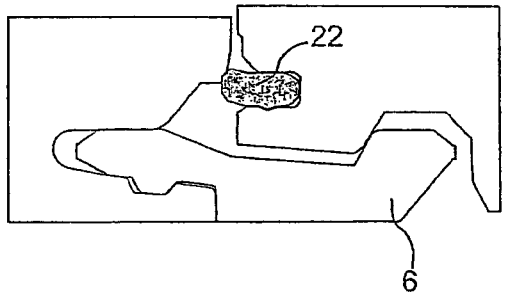
Figure 35E:
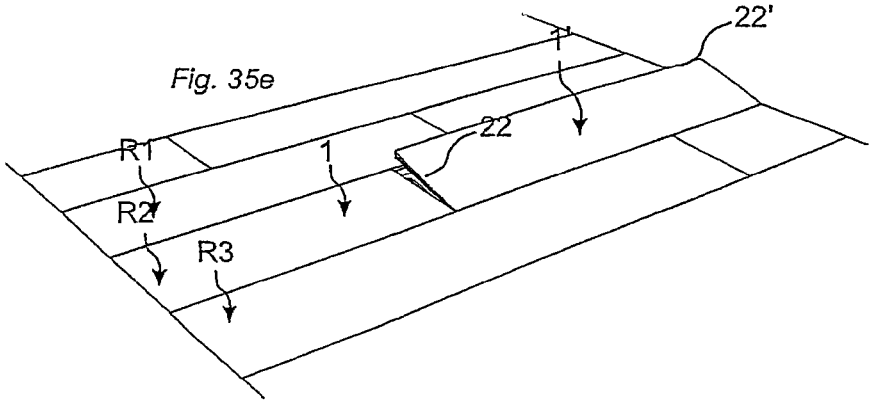

FIGS. 35*a-e* show how a joint system can be made with a flexible tongue 22 which can be displaced and/or compressed horizontally H1, H2 or alternatively be bent vertically up V1 or down V2. FIG. 35*a* shows a separate tongue 22 of, for instance, wood fibre material which can be displaced horizontally in the H1, H2 direction by means of a flexible material 70, for instance a rubber paste. FIG. 35*b* shows an embodiment with a tongue 22 which has an inner part that is resilient. FIGS. 35*c-d* show how a flexible tongue can be dimensionally changed so that locking and unlocking can take place with a vertical motion. FIG. 35*e* shows how a first floorboard 1' can be detached by upward angling using e.g. suction cups or suitable tools that are applied to the floorboard edge closest to the wall. The floorboard has on a long side and a short side flexible tongues 22' and 22. After upward angling, an adjoining floorboard in the same row R2 can be detached and optionally be laid again in the same way. When the entire row is detached, the rows R1 and R3 can be taken up in a prior-art manner. Floorboards with such a preferred system has great advantages, above all in large floors. Floorboards can be exchanged in any row. A damaged floorboard in the centre of a floor can, with most of today's locking systems, only be exchanged if half the floor is taken up. For instance, the floor may consist of one or more rows of the above-mentioned floorboards in the portions where the taking-up possibility is particularly important. The tongue 22 should preferably be made of flexible material, such as plastic. Wood-fibre-based materials can also be used, for instance HDF. Vertical taking-up is facilitated if the flexible tongue is combined with a strong and flexible loose strip which has a preferably strong and flexible locking element having smooth locking surfaces with low friction.

Figure 36A:
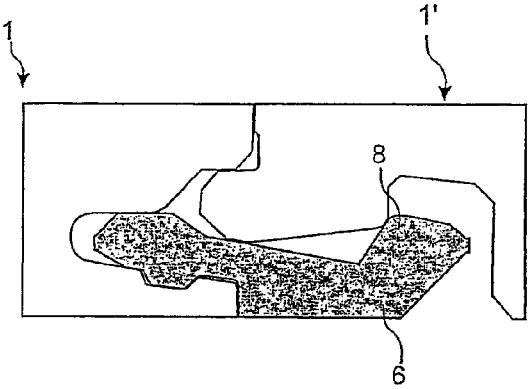
FIGS. 36*a-c* show a method of detaching floorboards having a separate strip.
Figure 36C:
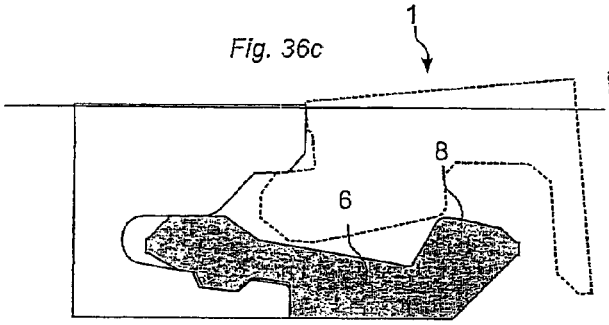
Figure 36B:
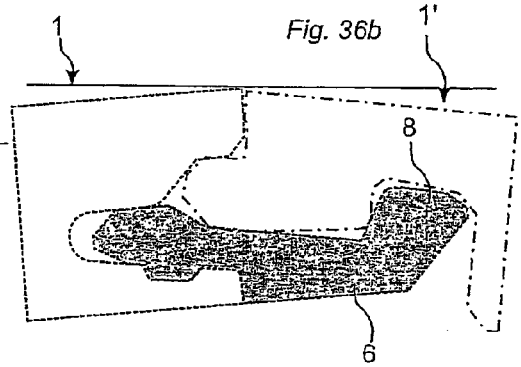

FIGS. 36*a*-36*b* show how a joint system with a separate strip can be designed to allow an angular motion in prior-art manner with the rear sides of the floorboards against each other. Such systems are available only with the strip made in one piece with the core of the floorboard and are difficult to use. FIG. 36*b* shows how the floorboards 1, 1', in relative backward bending through about 10 degrees, detach the tongue side in the floorboard 1 which can be detached at half the angle, in this case about 5 degrees. With this method, individual boards cannot be detached. At least two rows must usually be angled upward at the same time. Backward angling is facilitated significantly if the strip is wide, has low friction and is flexible. A rotary motion in the groove where the strip 6 is attached is also advantageous. All this can be achieved with a separate strip adapted to this function.

It is obvious that a large number of variants of preferred embodiments are conceivable. First, the different embodiments and descriptions can be combined wholly or partly. The inventor has also tested a number of alternatives where geometries and surfaces with different angles, radii, vertical and horizontal extents and the like have been manufactured. Bevelling and rounding-off can result in a relatively similar function. A plurality of other joint surfaces can be used as positioning surfaces. The thickness of the strip may be varied and it is possible to machine materials and make strips of board materials that are thinner than 2 mm. A large number of known board materials, which can be machined and are normally used in the floor, building and furniture industries, have been tested and found usable in various applications of the invention. Since the strip is integrated mechanically, there are no limitations in connection with the attachment to the joint edge as may be the case when materials must be joined with each other by means of gluing.

Figure 36D:
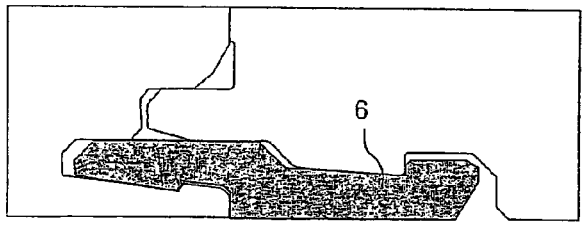
FIGS. 36*d-f* show how prior art locking systems may be adapted for use with the herein disclosed separate strip.
Figure 36E:
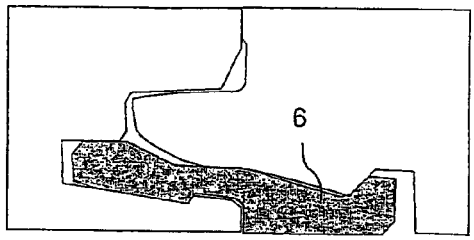
Figure 36F:
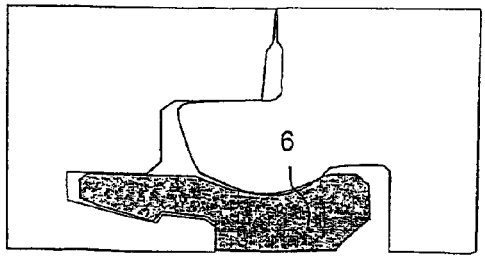

Most prior-art locking systems can, as exemplified in FIGS. 36*d*-36*f*, be adjusted for use of a separate locking strip, as described above. It will thus be appreciated that a locking strip made by machining of a sheet-shaped material, for instance a wood-based material, need not necessarily exhibit all the features stated in the appended claims. It will also be appreciated that the locking strip can also be made, for instance, by extrusion or injection moulding of polymeric or metallic materials, in which case, for instance, the geometries, shown herein, of both locking strip and joint edge of the floorboard may be utilised.

The invention claimed is:

1. A floorboard comprising:

an upper side and a lower side opposite the upper side, the lower side configured to face a subfloor;

connecting means integrated with the floorboard and adapted to connect a first edge of the floorboard with a second edge of an essentially identical floorboard, wherein upper joint edges of said floorboard and said essentially identical floorboard in a connected state define a vertical plane, said connecting means being adapted to connect said floorboard with said essentially identical floorboard in at least a horizontal direction perpendicular to said vertical plane, said connecting means comprising a locking strip which projects from said vertical plane and carries a locking element which is adapted to cooperate, in said connected state, with a downward open locking groove of said essentially identical floorboard, said locking strip is a separate part which is mechanically fixed to the floorboard in said horizontal direction and a vertical direction, wherein said locking strip is mechanically fixed to the floorboard at a joint by snapping-in or inward angling, said locking strip comprising a strip tongue, said locking strip adapted for connecting the floorboard with the essentially identical floorboard by at least inward angling, such that when the second edge is pressed against an upper part of the first edge and is then angled down, the locking element can enter the locking groove, wherein the joint comprises a strip groove adapted to receive the strip tongue and wherein the strip groove is a sideward open groove having an upper surface and a lower surface opposite the upper surface, the strip groove adapted for retaining the strip tongue in the strip groove when the strip groove is arranged in connection to the strip tongue, the locking strip is mechanically fixed to the floorboard by way of said strip tongue being mechanically fixed within the strip groove forming a joint which is only operable by snapping in and/or inward angling and wherein the locking strip extends horizontally beyond the outer parts of the strip groove.

2. The floorboard as claimed in claim 1, wherein the locking strip is of a metallic material.

3. The floorboard as claimed in claim 2, wherein the locking strip is of aluminum.

4. The floorboard as claimed in claim 2, wherein the locking strip is of extruded aluminum.

5. The floorboard as claimed in claim 1, wherein the locking strip is of a thermoplastic, composite or polymeric material.

6. The floorboard as claimed in claim 1, wherein the locking strip essentially consists of a machined sheet-shaped material.

7. The floorboard as claimed in claim 6, wherein the locking strip is formed by machining.

8. The floorboard as claimed in claim 1, wherein said connecting means are adapted for connecting the floorboard with the essentially identical floorboard by snapping-in in an essentially horizontal direction.

9. The floorboard as claimed in claim 1, wherein said connecting means are adapted for disconnecting said floorboard from said essentially identical floorboard by an angular motion in a direction opposite to a direction of the inward angling.

10. The floorboard as claimed in claim 1, further comprising:

a tongue groove for connecting the floorboard to said essentially identical floorboard in the vertical direction perpendicular to a principal plane of the floorboard, wherein the tongue groove is adapted for receiving a tongue arranged on said essentially identical floorboard, wherein at least one surface of said tongue groove is said locking strip.

11. A floorboard as claimed in claim 10, wherein said tongue is a separate part which is designed to engage, in said connected state, in said tongue groove and in a corresponding groove in said essentially identical floorboard.

12. A floorboard as claimed in claim 11, wherein said tongue is horizontally displaceable or elastically deformable.

13. The floorboard as claimed in claim 10, further comprising:

a locking surface arranged in said strip groove and adapted to cooperate with a locking surface arranged on said locking strip.

14. The floorboard as claimed in claim 13, wherein said locking surface arranged in the strip groove is arranged on a lower lip which defines said strip groove, and wherein said locking surface arranged on the locking strip is arranged on a lower surface of said locking strip.

15. A floorboard as claimed in claim 14, wherein the locking strip forms an extension of said lower lip.

16. A floorboard as claimed in claim 14, wherein said lower lip projects from said vertical plane.

17. The floorboard as claimed in claim 1, wherein the locking strip is detachable from said floorboard by an angular motion in a direction opposite to a direction of the inward angling.

18. The floorboard as claimed in claim 1, wherein the locking strip is made of essentially wood-based material.

19. The floorboard as claimed in claim 18, wherein said wood-based material is selected from the group consisting of pure wood, particle board, plywood, HDF, MDF and compact laminate.

20. The floorboard as claimed in claim 18, wherein said wood-based material is impregnated or coated with a property-improving agent.

21. The floorboard as claimed in claim 18, wherein said wood-based material comprises a curing polymer material.

22. A floorboard as claimed in claim 18, wherein said wood-based material is formable by machining.

23. The floorboard as claimed in claim 1, wherein the floorboard is quadrilateral and, along at least two mutually perpendicular edge portions, has first and second sets of connecting means.

24. The floorboard as claimed in claim 23, wherein said first set of connecting means is arranged on a short side of the floorboard and said second set of connecting means is arranged on a long side of the floorboard, said first set of connecting means differing from said second set of connecting means in terms of material property or material composition.

25. The floorboard as claimed in claim 24, wherein a locking strip included in said first set of connecting means differs in terms of material property or material composition from a locking strip included in said second set of connecting means.

26. The floorboard as claimed in claim 25, wherein the locking strip included in said first set of connecting means has higher strength than the locking strip included in said second set of connecting means.

27. The floorboard as claimed in claim 1, wherein the strip groove faces in a direction different from the direction in which the downward open locking groove faces.

* * * * *